US011495109B2

(12) United States Patent
Thiel et al.

(10) Patent No.: US 11,495,109 B2
(45) **Date of Patent: *Nov. 8, 2022**

(54) BUILDING LOCKDOWN SYSTEM

(71) Applicant: THE LOCKOUT CO., LLC, Brighton, MI (US)

(72) Inventors: Joseph A. Thiel, Brighton, MI (US); Robert Couturier, Williamston, MI (US)

(73) Assignee: The LockOut Co., LLC, Brighton, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/939,990

(22) Filed: Jul. 27, 2020

(65) Prior Publication Data

US 2020/0357255 A1 Nov. 12, 2020

Related U.S. Application Data

(63) Continuation of application No. 15/891,976, filed on Feb. 8, 2018, now Pat. No. 10,726,697.

(51) Int. Cl.
*E05C 19/18* (2006.01)
*G08B 21/02* (2006.01)
(Continued)

(52) U.S. Cl.
CPC ..... *G08B 21/0297* (2013.01); *E05B 41/00* (2013.01); *E05B 45/06* (2013.01);
(Continued)

(58) Field of Classification Search
CPC ..... G08B 21/0297; G08B 25/10; F21K 9/238; E05B 41/00; E05B 45/06; E05B 13/00;
(Continued)

(56) References Cited

U.S. PATENT DOCUMENTS

2015/0114763 A1* 4/2015 Kim ..... B66B 5/0012 187/392
2016/0186470 A1* 6/2016 Finley ..... E05B 45/06 292/339

(Continued)

*Primary Examiner* — Benyam Haile
(74) *Attorney, Agent, or Firm* — Dickinson Wright PLLC

(57) ABSTRACT

A lockdown system for use in a building including multiple rooms with doors providing access to the rooms, the lockdown system including: at least one room lockdown component provided in each of a plurality of the rooms, the room lockdown components comprising door-securing devices that are external of the doors and, in a deployed condition of the room lockdown components, are manually positioned inside said rooms to oppose inward movement of the doors and thereby block or secure the doors, the room lockdown components further characterized by a non-deployed condition in which the door-securing devices are positioned at storage locations inside the rooms, and wherein further each room lockdown component is operative to automatically signal initiation of a lockdown event when its door-securing device has been moved from its storage location; and at least one communication device operative to receive the signaled initiation of a lockdown event when any one or more of the door-securing devices have been moved from their storage locations, and to provide an alert notification of the initiation of the lockdown event.

45 Claims, 16 Drawing Sheets

(51) Int. Cl.

| | |
|---|---|
| ***G07C 9/00*** | (2020.01) |
| ***E05B 45/06*** | (2006.01) |
| ***E05B 41/00*** | (2006.01) |
| ***F21K 9/238*** | (2016.01) |
| ***G08B 25/10*** | (2006.01) |
| *E05B 63/00* | (2006.01) |
| *E05B 47/00* | (2006.01) |
| *E05B 13/00* | (2006.01) |
| *F21V 23/00* | (2015.01) |
| *F21V 23/04* | (2006.01) |

(52) U.S. Cl.

CPC ..... *E05C 19/18* (2013.01); *E05C 19/184* (2013.01); *E05C 19/188* (2013.01); *F21K 9/238* (2016.08); *G07C 9/00* (2013.01); *G07C 9/00571* (2013.01); *G07C 9/00896* (2013.01); *G08B 25/10* (2013.01); *E05B 13/00* (2013.01); *E05B 2047/0067* (2013.01); *E05B 2047/0094* (2013.01); *E05B 2063/0039* (2013.01); *E05Y 2900/132* (2013.01); *F21V 23/005* (2013.01); *F21V 23/045* (2013.01)

(58) Field of Classification Search

CPC ..... E05C 19/18; G07C 9/00; F21V 23/005; F21V 23/045

See application file for complete search history.

(56) References Cited

U.S. PATENT DOCUMENTS

2016/0232728 A1* 8/2016 Allibhoy ..... G07C 9/00309
2017/0069196 A1* 3/2017 Jacobs ..... G08B 27/00

* cited by examiner

BUILDING LOCKDOWN SYSTEM

CROSS-REFERENCE TO RELATED APPLICATIONS

The present application is a continuation of, and claims the benefit of priority from, U.S. patent application Ser. No. 15/891,976, filed 8 Feb. 2018, and through which priority is claimed to U.S. Provisional Application Ser. No. 62/531,649, filed Jul. 12, 2017, and U.S. Provisional Application Ser. No. 62/456,179, filed Feb. 8, 2017, the disclosures of which are incorporated herein by reference in their entireties.

FIELD OF THE INVENTION

The subject matter of the present application is in the field of security lockdown devices and systems of the type used in buildings, including schools and similar institutional settings.

BACKGROUND

Devices for "locking down" or securing individual rooms against intrusion in institutional settings have become increasingly common due to a greater perceived threat of violence against the resident populations. Schools are a prime example of such institutions, and various methods and devices have been proposed to reliably secure school rooms in response to intruder alerts.

One such device and system is disclosed in U.S. Published App. No. 2014/0306466 to Couturier, the entirety of which is incorporated herein by reference. A door blocking plate has a pair of strong, spaced pins that mate with floor sockets adjacent the inside face of a door. If the door normally opens inward, the plate prevents the door from being forced inwardly from the outside. If the door normally opens outward, a bracket on the inside face of the door forms a large slot through which the plate is dropped to engage the floor sockets, with a portion of the plate extending above the bracket to prevent the door from being pulled open from the outside. A specialized tool can also be provided to release the installed plate from outside the door.

SUMMARY

The present invention is a system and method for allowing outside authorities to manage a lockdown procedure from an external location through a BLE smart lighting grid in a building including multiple rooms with doors providing access to the rooms.

The lockdown system includes smart light fixtures positioned inside and outside at least a plurality of the rooms. At least some of the smart light fixtures are configured to be selectively illuminated in each of a plurality of colors. Room lockdown components are provided in at least some of the plurality of rooms. The room lockdown components are adapted to block or secure the door of the room against opening in a deployed condition thereof.

The smart light fixtures and the room lockdown components are equipped with BLE sensors defining a mesh network. The room lockdown components are each adapted to communicate, via the BLE mesh network, at least whether they are in the deployed condition thereof.

At least one primary communication and control ("PCC") device disposed in the building is in communication with, and operative to control, at least some of the smart light fixtures via the BLE mesh network.

At least one secondary communication and/or control device may also be disposed in the building in communication with the primary communication and control device so as to receive notifications therefrom.

In one embodiment, an external communication and control device is provided, being disposed at a location remote from the building and in communication with, and operative to control, at least some of the smart light fixtures. The external communication and control device and the primary communication and control device each receive information as to whether the room lockdown components are in the deployed condition thereof. The external communication and control device and the primary communication and control device are each operative to independently effect a change in the color of at least some of the smart light fixtures in the smart lighting grid.

In a particular form, the at least one PCC device comprises a portable smartphone or tablet type portable computer, although it may comprise any portable computing device or system with sufficient memory, processing capacity, mobility, and communication capability to achieve the desired communication and control functions as an intermediary between the external computer and the BLE smart lighting grid.

In a further form, external control of the building lockdown system comprises three communication modes: visual control, wherein the outside authorities adjust visual signals such as lockdown status notifications and escape routes by selectively altering the lighting state of BLE light fixtures throughout the building, and/or by altering visual representations of the building lockdown status on PCC devices in the building; two-way text messaging control through the BLE smart lighting grid, in which multiple authorized PCC devices in the hands of administrators or staff are provided with blanketed general messaging and/or individual, point-to-point messaging for the purposes of notification and/or intelligence gathering; and text to audio control, wherein BLE-equipped light fixtures and room lockdown components are also equipped with audio speakers for relaying audio messages from the outside authorities through the BLE mesh network in the building.

In a preferred form, the at least one PCC device may have varying levels of administrative and control access to and through the system. For example, a PCC device may provide the sole gateway to and from the outside authorities with respect to the BLE mesh network in the building, while secondary communication and/or control devices in the hands of lower-tier personnel in the building may be limited to receiving notifications/instructions, or to two-way communication with the PCC device through the BLE mesh network. Such devices may also have compartmentalized functions, e.g., regular mobile phone or email communication with the outside world, as well as specially programmed, specially authorized emergency communication through the BLE mesh network.

In a further form, the system comprises two-way text to audio devices in at least some of the BLE mesh network components, able to send real-time text to audio through the smart lighting grid via the at least one PCC device to the outside authorities. The two-way audio devices may optionally include shot detection circuitry that, upon activation by the noise of a gunshot, initiates communication back to the outside authorities.

In a further form, the system comprises a method of sending text messages through the BLE mesh network in the building from an external web-based messaging system.

These and other features and advantages of the invention will become apparent from the detailed description below, in light of the accompanying drawings.

DETAILED DESCRIPTION

The following terms are used herein with the given definitions:

"BLE sensor" will be used herein as shorthand for a BLE (or equivalent) wireless communication module or transceiver device with a sensing and/or signal relaying function, and "BLE" will be used to describe a physical portion of the lockdown system equipped with such a device.

"Building" should be understood to include single buildings as well as multi-building complexes. For simplicity, the example of a school building with classrooms will be referred to throughout. However, it should be understood to include other multi-room buildings where relatively defenseless populations are vulnerable to dangerous intruders, such as, by way of non-limiting example, senior care facilities, hospitals, businesses, and the like.

A "smart room lighting fixture" should be understood to comprehend a lighting fixture that is able to wirelessly receive and transmit short-range signals from and to compatible wireless devices in a building. A "smart lighting grid" should be understood to comprehend a plurality of "smart room lighting fixtures" which are arranged so as to form a network of interconnected fixtures.

Figure 1:
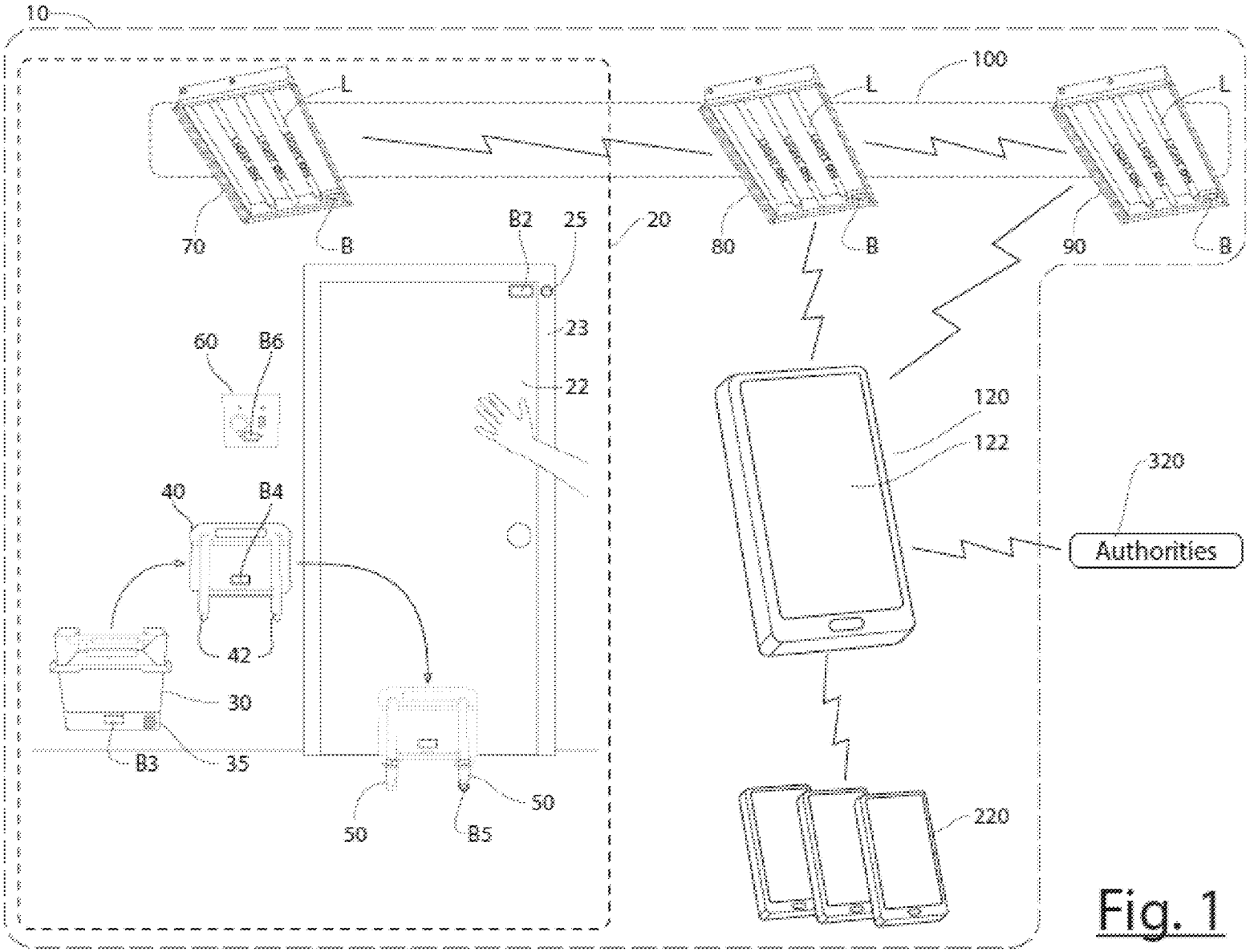
FIG. 1 is a schematic diagram of a school building with a BLE mesh network comprising a BLE smart lighting grid and at least one room provided with BLE-equipped lock-down components, a primary communication and control ("PCC") device, and a communication link to an external computer managed by outside authorities, according to an example of the inventive system.

Referring first to FIG. 1, a school building 10 is shown in schematic, simplified form in order to teach how to make and use the claimed invention. The building 10 which, according to the illustrated embodiment, is a school building (but which may be any building as defined above)—has multiple rooms 20, e.g., classrooms, which might need to be locked down by securing their doors 22 to protect the people inside from intruders. A single room 20 with a single door 22 is shown in FIG. 1 for illustrative purposes.

Room 20 is shown supplied with the room lockdown system components which, in the illustrated example (see also FIG. 2), include a door-securing device ("boot") 40 and a storage device ("box") 30 for storing the boot 40 in a convenient location near door 22. Box 30 may be any kind of receptacle, rack, or holder and is relatively permanently fixed in place near the door; in the illustrated example, box 30 is a fully enclosed receptacle with an upper hinged lid 32 and an audible alarm speaker 35, secured to the wall near the door. Optionally, box 30 includes a status indicator light on it to visually indicate the current status of the boot 40 as described further below.

Boot 40 in the illustrated example is a plate-like device according to the teachings of U.S. Published App. No. 2014/0306466 to Couturier, referenced above and incorporated herein by reference in its entirety, with a pair of strong pins 42 on its lower end for insertion into mating sockets 50 formed in the floor adjacent door 22. However, boot 40 and sockets 50 may take different structural forms for purposes of the system of this disclosure; provided, however, that their function remains equivalent in terms of overall system response—i.e. placing the door-blocking device in a socket or similar door-associated receptacle or receiver serves to positively barricade the door and triggers a "lockdown" signal from an associated BLE sensor.

Room 20 also includes a light switch 60 for turning a room light fixture 70 on and off. In the preferred form, at least one light fixture 70 is associated with door 22 inside the room, by being located at or near the door 22. Light fixture 70 is equipped with a BLE sensor B of known, commercially available type that is incorporated, for example, in a driver board of one of the LED light tubes L in known manner, and is part of a "smart" lighting grid 100 formed by other BLE-equipped smart light fixtures 70, 80, and 90 throughout the building.

In the illustrated example, a BLE light fixture 80 is associated with door 22 outside the room 20 in a hallway, and at least one other "distributed" or remote BLE light fixture 90 is associated with the hallway or some other part of the building, such as, for example and not by way of limitation, the principal's office or a main administrative or security office, farther away from room 20. It should be understood that the typical building (e.g., school) will have many rooms 20, each with its own door-associated BLE light fixtures 70, 80, and different hallways, wings, or outbuildings with their own distributed BLE light fixtures 90 in wireless communication with the nearest fixtures 70, 80, and/or 90 to collectively define a wireless network for receiving and conveying signals in the manner herein described.

Figure 9:
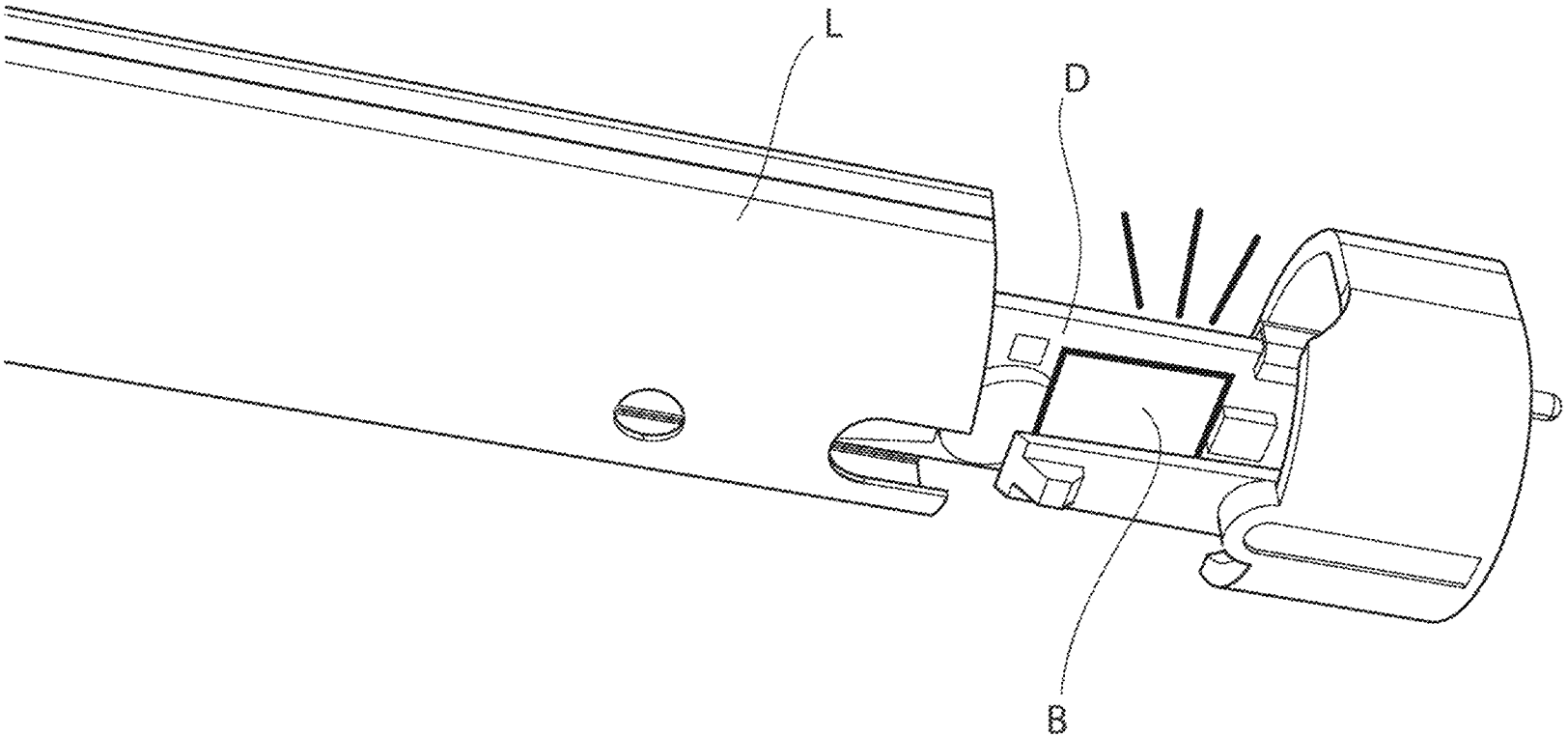
FIG. 9 shows one option for mounting a BLE sensor in the light fixtures comprising the "smart" lighting grid of the present invention.

Lighting grid 100 is able to wirelessly receive and transmit short-range signals from and to compatible wireless devices in the building, starting at one or more light fixtures near the signal source and then relaying the signal(s) to the other BLE fixtures 70, 80, and 90 in grid 100 in known manner. It will be appreciated that the BLE smart light fixtures in the building define in this manner a BLE "mesh"-type network. An LED light tube with inter-fixture and intra-building communication and signal capability for such a system is disclosed in co-pending U.S. application Ser. No. 15/689,947 (Thiel) filed Aug. 29, 2017, the entirety of which is incorporated herein by reference. Another example is shown in U.S. Pat. No. 8,214,084 (Ivey et al.) and titled "Integration of LED Lighting with Building Controls," the disclosure of which is also incorporated herein by reference in its entirety. FIG. 9 illustrates an example method for mounting a BLE sensor B in one of light fixtures 70, 80, or 90 in grid 100. In FIG. 9, BLE sensor B has been mounted on the driver board D of one of the light tubes L in the fixture, as taught in the Thiel application referenced above.

Still referring to FIG. 1, the door 22, boot box 30, boot 40, at least one of floor sockets 50, and light switch 60 are also equipped with BLE sensors B2, B3, B4, B5, and B6, respectively. In the illustrated system the BLE sensors Bn are similar or identical in terms of their wireless signal-relaying function to the BLE sensors B in the light fixtures, and each is coupled to (or includes) a switch or position sensor associated with the state-variable portion of the system on which it is mounted in order to signal a change in condition or position.

For example, BLE sensor B2 may be on door 22 as illustrated, or on doorframe 23, coupled to a switch or position sensor 25 associated with the doorframe or door, so that movement of door 22 to the closed position triggers a "closed" signal from the BLE sensor B2 that is relayed to BLE sensor B in light fixture 70 and from there to other smart lighting fixtures in the smart lighting grid 100. Switch or position sensor 25 may comprise a magnetic door switch of common type, mechanically fastened or adhered to the door frame and door.

BLE sensor B3 in boot box 30 may comprise a mechanical switch that is activated by being depressed or released by boot 40 as it is inserted or removed from the box. Audible alarm speaker 35 may be a self-contained, battery-operated alarm activated by sensor B3 when the boot 40 is removed from box 30.

BLE sensor B4 on boot 40 may comprise an accelerometer type sensor activated by movement in any direction. Sensors B3 and B4 act in conjunction to detect activation of the system as a dual failsafe. The boot box sensor B3 and boot sensor B4 preferably operate independently, and do not require coordination with each other to individually initiate a lockdown. Rather, the activation of either is sufficient. The justification for this independence and redundancy is to prevent the situation where an unauthorized individual places an object in the box 30 in order to "fool" the sensor B3 into registering the presence of the boot 40 even after the boot is removed from the box. Manifestly, the accelerometer of sensor B4 on boot 40 cannot be "fooled" in this fashion and will, instead, register movement as boot 40 is withdrawn from box 30 during, or in initiation of, a lockdown.

BLE sensor B5 in one of the floor sockets 50 may comprise a magnetic proximity switch between the boot and the bottom of the floor socket. For example, when a large metal "contact" portion on the boot body nears a sensor portion on the bottom of the floor socket, sensor B5 is activated.

BLE sensor B6 in light switch 60 may comprise a common mechanical light switch activating a magnetic switch (not illustrated) in the wall behind the switch plate.

Figure 2:
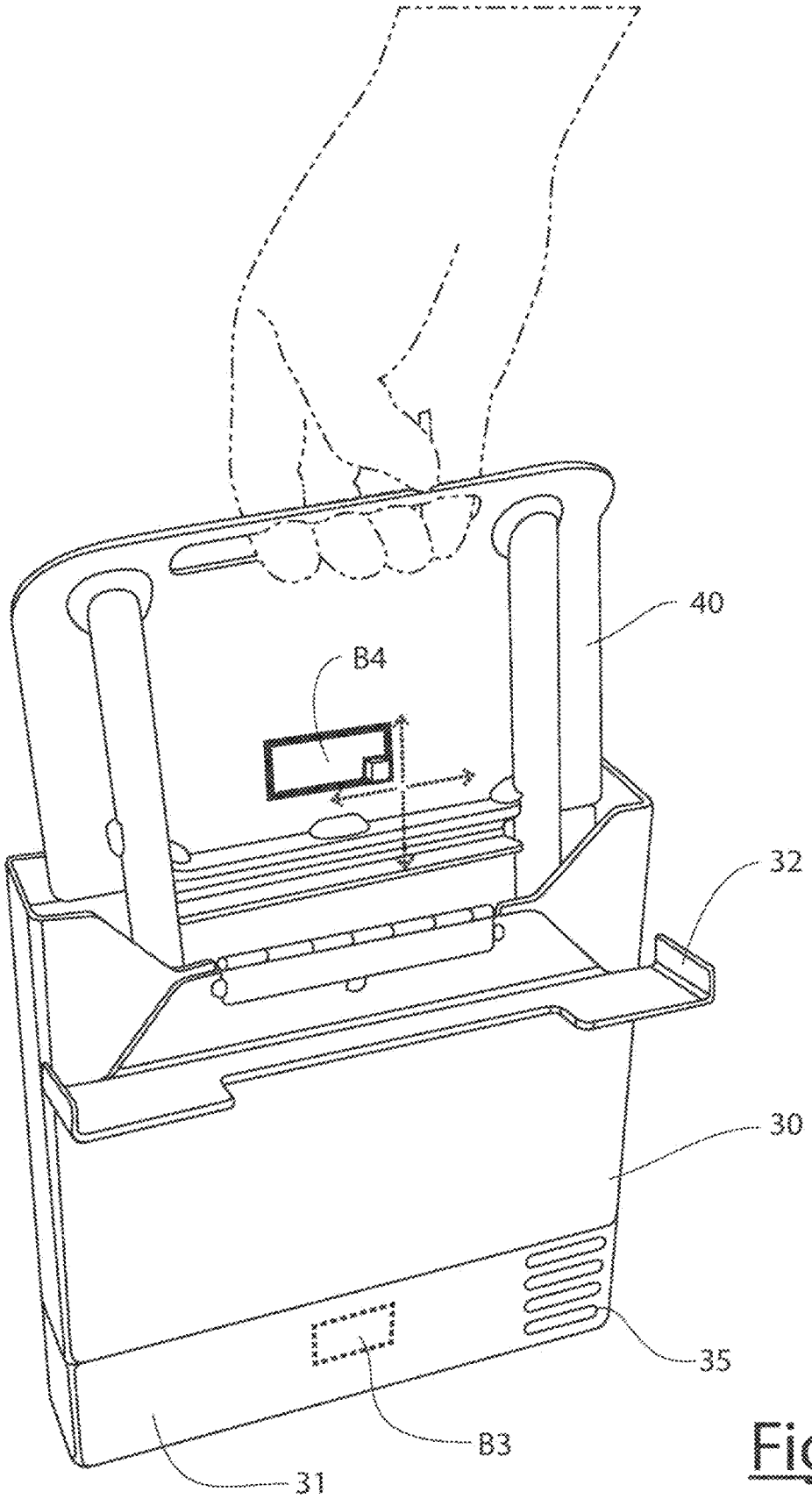
FIG. 2 is a detailed view of the boot storage box from the system in FIG. 1, with the box being opened to remove the boot stored inside.

Referring to FIGS. 1-2, BLE sensor B3 in boot box 30 preferably has a master function, in that none of the state-variable component BLE sensors B2, B4, B5, or B6 is enabled or "on" until BLE sensor B3 is activated (sensors B in lighting grid 100 are always enabled). Sensor B3 is the master switch for the system and is identified as such in the system. Sensor B4 is preferably a backup or independent master switch as a failsafe measure; if sensor B4 is moved in any direction it also activates sensors B2, B5, and B6.

BLE sensor B3 is activated when boot 40 is removed from box 30, for example by mechanically decoupling the boot 40 from sensor B3 on the bottom of the box 30; once the weight of the boot is removed, the switch is released and the system is activated. Sensor B3 may be powered on by its own internal battery, or by a battery in a substation 31 in the box, to send a wireless signal to each of the other state-variable room component sensors B2, B4, B5 and B6 to enable or power them on. Simultaneously, sensor B3 signals sensor B in room light fixture 70 that boot 40 has been removed from box 30.

Once the initial boot-out signal is given by B3 in box 30 (and optionally simultaneously by sensor B4 on boot 40), the room must be locked down from the inside by blocking door 20 with boot 40.

Figure 4A:
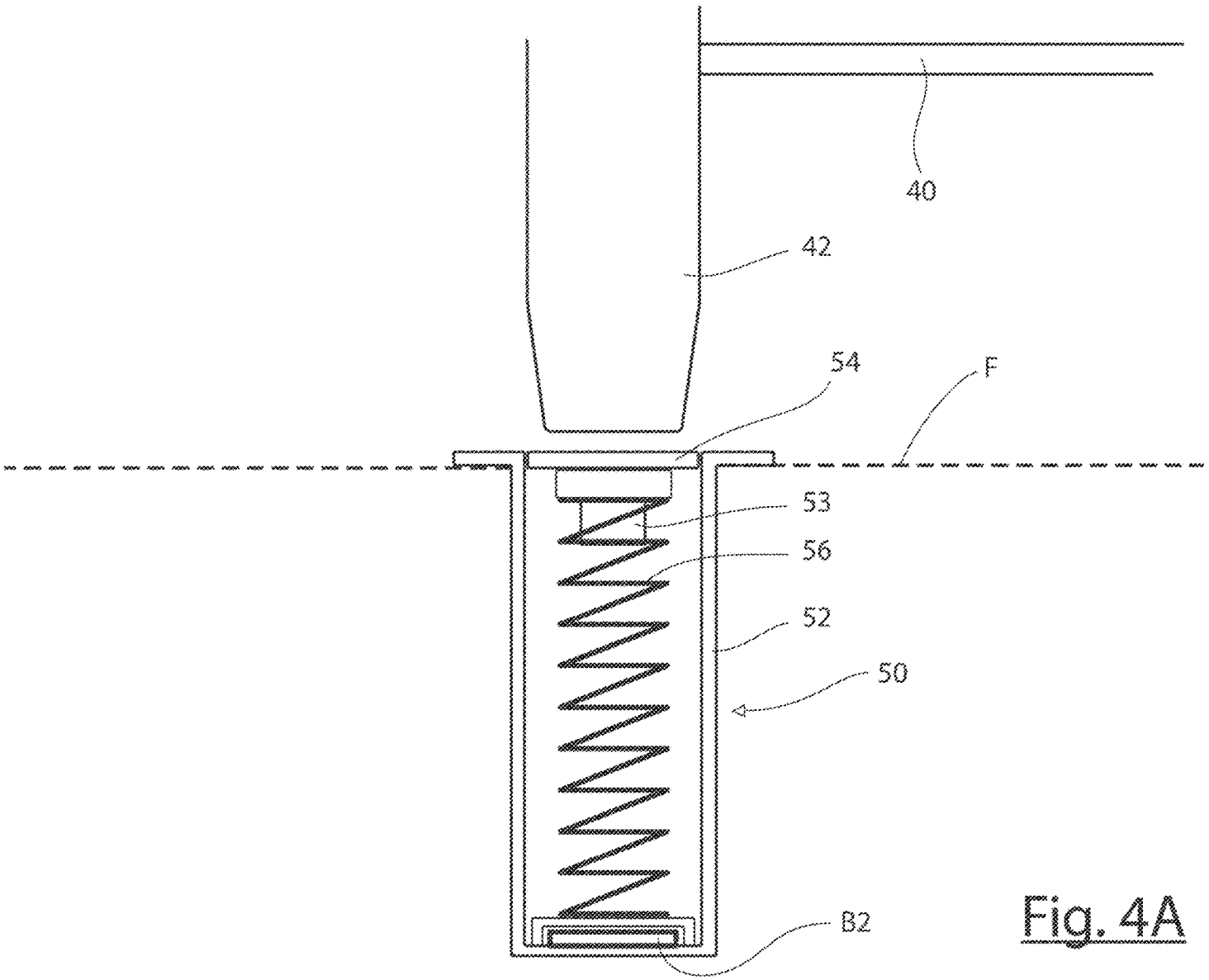
FIGS. 4A and 4B show detailed views of one of the floor sockets of FIG. 1 in section, in different operative states.
Figure 4B:
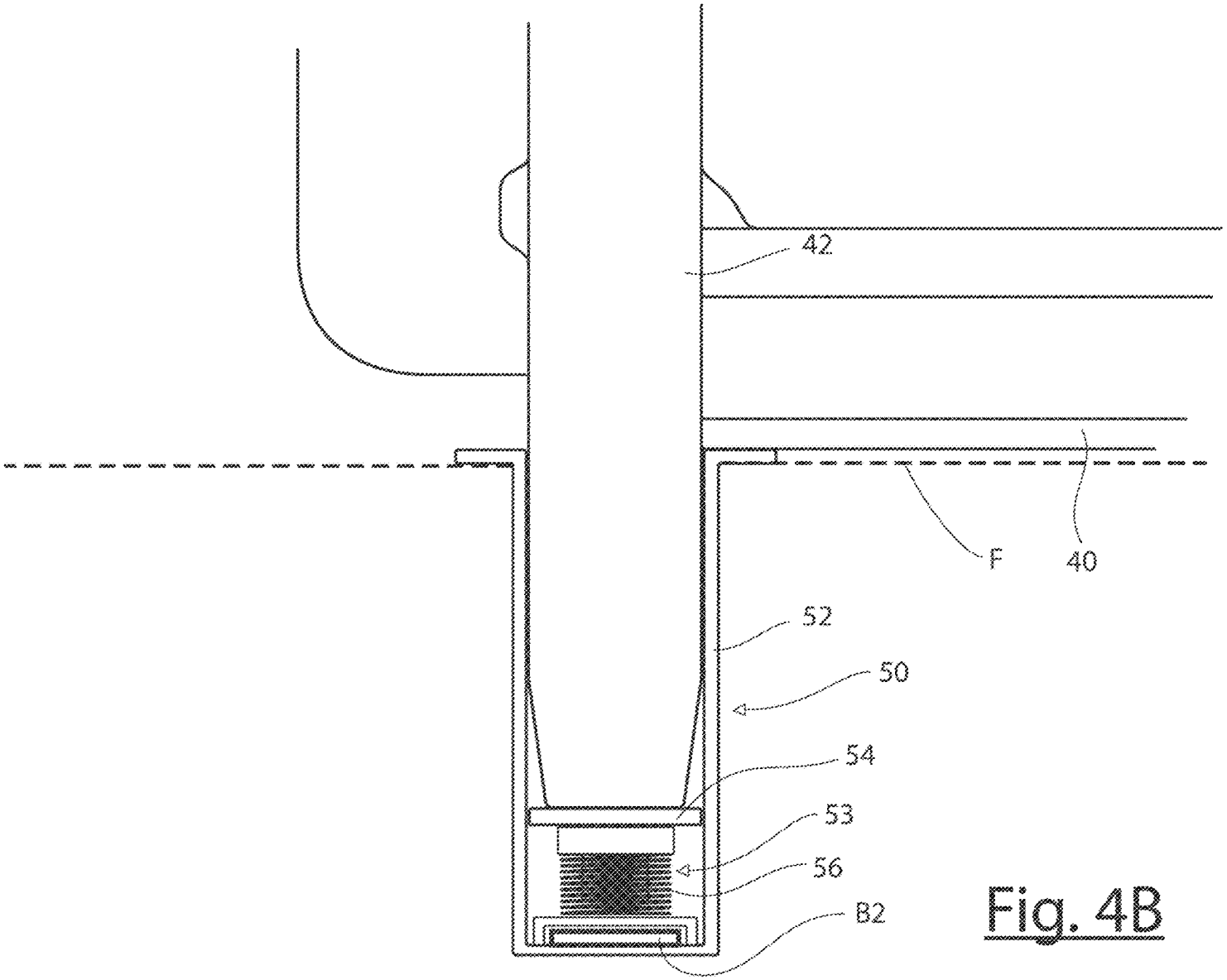

FIGS. 4A and 4B show one of the two pins 42 on boot 40 being inserted in its respective socket 50. In the illustrated example, socket 50 is a metal tube 52 mounted in a matching bore in the floor F. A plunger 54 in the socket is biased upwardly by a spring 56 to normally close off (FIG. 4A) the open upper end of tube 52. The lower end of tube includes the BLE sensor B5, and the lower end of plunger 54 includes a switch contact 53 that when coupled to sensor B5 at the bottom of the tube (FIG. 4B) causes sensor B5 to send a "boot-in-socket" signal to the lighting grid 100 through associated light fixture 70, which alone may be used to indicate that the room is locked down. The coupling of switch contact 53 and sensor B5 may take different forms, for example mechanical, direct electrical, or inductive.

The illustrated system further includes at least one primary communication and control (PCC) Bluetooth (or equivalent) compatible device 120 (e.g., a smartphone, a portable tablet computer, desktop computer, etc.) configured to communicate with at least the BLE sensors in the light fixtures of grid 100. The PCC device 120 is preferably, though not necessarily, carried by a designated person or persons of authority or responsibility in the building, such as security personnel, the school principal, etc. The signal from the BLE sensor on any fixture 70, 80, or 90 in the grid is sufficient to activate an "alert" signal on PCC device 120. For example, and without limitation, display 122 may light up with a visible alert notice, or device 120 may emit a sound or vibration, or all of the above may occur, in response to any change in status of the lockdown components.

PCC device 120 in the illustrated example is a "primary" communication and control device. As mentioned below, the PCC device may in one embodiment provide the sole gateway to and from outside security personnel 320 (e.g., police, firefighters, and/or other first responders and designated generally as "Authorities" in FIG. 1) with respect to the BLE mesh network in the building.

In comparison, secondary wireless communication and/or control devices 220 in the hands of lower-tier personnel in the building may be limited to receiving notifications/instructions, or to two-way communication with the PCC device through the BLE mesh network. However, the secondary communication and/or control devices 220 may also, in one form of the invention, be adapted to also control the system to at least initiate a lockdown in the same manner as described with respect to the PCC device 120.

The at least one PCC device 120 (it is contemplated that more than one such "primary" communication and control device may be provided in a given building, for purposes of redundancy, to permit faster response time in the event of an intruder, etc.) can also communicate with the secondary wireless communication and/or control devices 220 in building 10, and/or with security personnel 320 outside building 10, in order to alert them to a lockdown situation, to coordinate security responses, etc. These alerts may be performed manually by dialing the phone; or automatically by the PCC device 120 upon receiving a lockdown alert from one of the rooms in the building; or upon the PCC device 120 being used to send a lockdown alert to the rooms in the building. Communication between the PCC 120 and secondary 220 devices may be in conventional wireless network fashion, via the BLE mesh network herein described, or via other conventional means.

PCC device 120 may have a number of pre-entered phone numbers stored in its memory, for example key personnel in the school building 10 with compatible phones (which may be the secondary communication and/or control devices 220) and/or outside security personnel 320 such as, by way of example, police and fire departments. PCC device 120 may be programmed to automatically send a voice, text, email, or similar wireless phone network alert to such personnel and authorities in response to receipt of an initial boot out (or completed lockdown) alert from the first room 20 in which a boot 40 is removed from its box 30. Alternately or additionally, PCC device 120 may be used to manually call, text, etc. the appropriate people inside and/or outside the building and alert them to the situation.

It should be understood that, within the range limits of the BLE sensors and the BLUETOOTH-compatible signal strength of the PCC device 120 communicating with the sensors, the person(s) equipped with a PCC device 120 may be able to receive and trigger lockdown alerts from adjacent exterior grounds associated with the building (e.g., parking lots, security booths, playgrounds, etc.).

Secondary communication and/or control devices 220 may be regular smartphones, tablet computers, etc., having direct, non-BLE wireless communication (mobile phone service, email, etc.) with the primary, PCC, device 120, or they may be secondary devices 220 configured for compartmentalized or dedicated communication with the PCC device 120 and with each other through the BLE smart lighting grid 100. Generally speaking, in the event of a room-initiated lockdown (FIG. 3A), in which one of the room lockdown components is moved to trigger its BLE sensor to send a signal to BLE light fixture 70, smart lighting grid 100 sends a signal to the PCC device 120. The signal from the BLE sensor on any fixture 70, 80, or 90 in the smart lighting grid near the person carrying PCC device activates an "alert" signal on that device 120. For example, display 122 may light up with a visible alert notice, or device 120 may emit a sound or vibration, or all of the above may occur. The administrator or other responsible person is accordingly alerted that at least one room 20 has initiated a lockdown due to a threat.

More particularly, the boot 40 is pulled from box 30 by a handle, causing sensors B3 and B4 to signal sensor B in fixture 70 of the boot's "out" status, and to also wirelessly enable the other BLE sensors B2, B5, and B6 in the room's system components 22, 40, 50, and 60. This puts system component sensors B2, B5, and B6 in condition to send component state-indicating signals to the smart lighting grid 100 through sensor B in lighting fixture 70 and begins an audible "Lockdown" (or other voice warning or alarm sound) output from speaker 35 and/or the status indicator at the boot storage box 30 location.

Referring again to FIG. 1, sensor B in room light fixture 70 relays the signal to the smart light fixture 80 outside the door, which in turn signals the nearest distributed fixture 90 that boot 40 has been pulled from box 30 in room 20. This signal in turn is relayed throughout all fixtures 70, 80, and 90 in the building.

Insertion of pins 42 into sockets 50 to block the door is sufficient to complete a locked-down condition for room 20. However, referring to FIG. 3A, a further step may be required to complete the lockdown procedure, as follows: After door 22 is closed, and boot 40 is engaged with sockets 50 in the floor by inserting boot pins 42 into the sockets, light switch 60 controlling fixture 70 and optionally any other non-BLE equipped light fixtures in room 20 is turned "off", either manually or automatically (this last step is in keeping with current lockdown protocols popular in the United States, in which the room is darkened after the door is shut and locked or barricaded). For example, BLE sensor B6 in light switch 60 may be coupled to an on/off control circuit in light switch 60 that is wirelessly responsive to sensor B5 in socket 50 to automatically turn switch 60 "off" independently of the manual light switch.

All other rooms 20 in the building 10, having been notified of the "boot-out" or other lockdown initiating component change in initiating room 20, quickly follow suit in response to the warning color change in their door-associated light fixtures 70 and 80, and also preferably by the audible alarms 35 in their boxes 30, and use the boots in their respective rooms to secure the doors thereof.

Figure 3A:
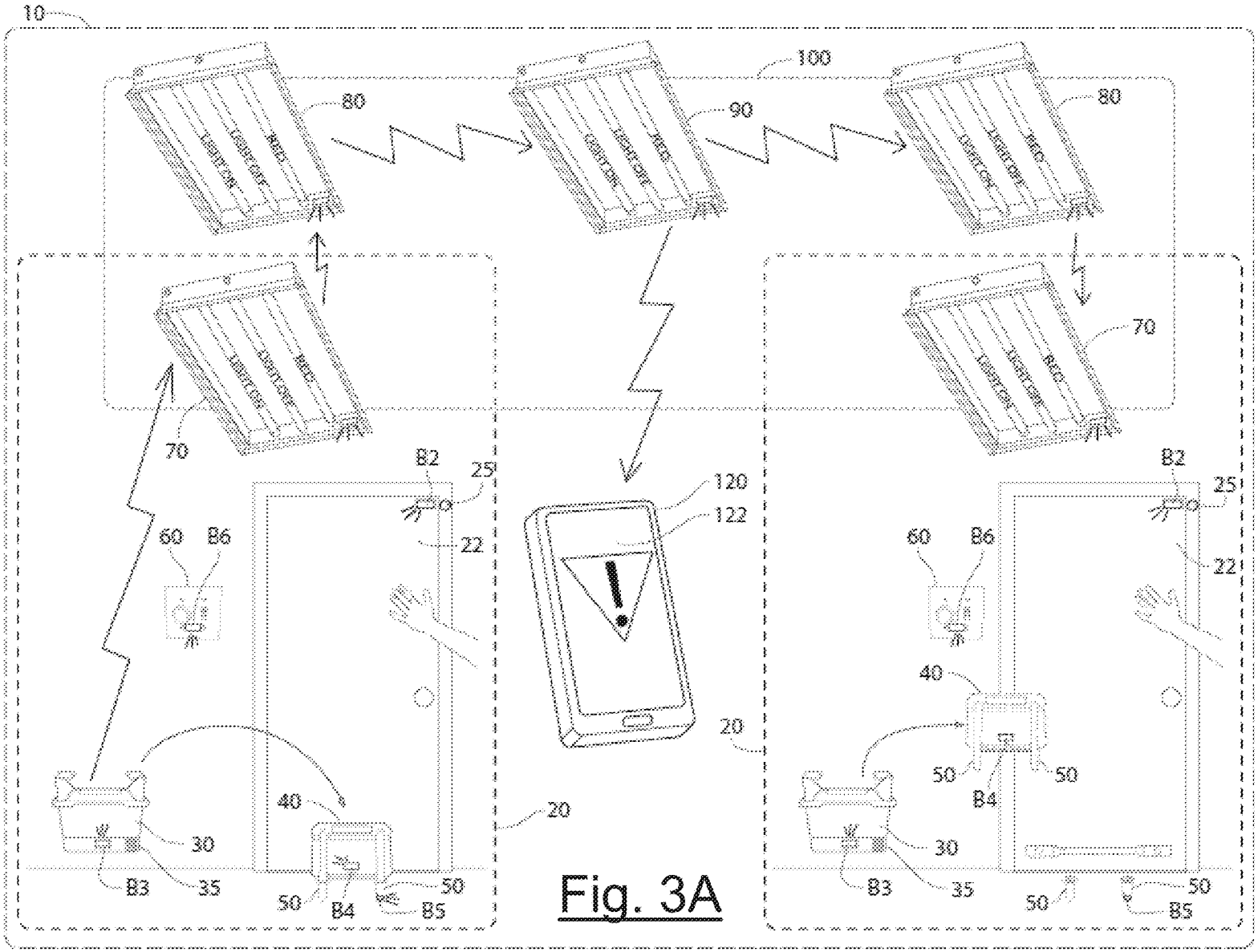
FIG. 3A schematically shows a system response to a room-initiated lockdown.

Still referring to FIG. 3A, the "boot out" signal from sensor B3 to B in fixture 70 is also relayed by B throughout the building via fixtures 80 and 90 in smart lighting grid 100. In the illustrated example, some or all of the smart light fixtures in the grid display or change lighting state to a "danger" indicating condition, for example by turning one or more of the light tubes in each fixture from white light to red light, and turning another tube off to dim the lights. At a minimum, fixtures 70 and 80 associated with each room door 22 should change color or otherwise display a "danger" lighting change, to alert those inside and immediately outside each room of the threat. In the other rooms 20 throughout building 10, the light fixture color change is an immediate and highly visible signal to pull boots 40 out of boxes 30 and barricade the doors. If only some of the distributed fixtures 90 in grid 100 are enabled to change color, they should be spread evenly throughout the building so that the greatest number of people in the building is likely to see the danger indication.

Still referring to FIG. 3A, smart lighting grid 100 sends a signal to the PCC device 120. The signal from the BLE sensor on any fixture 70, 80, or 90 in the grid near the person carrying PCC device activates an "alert" signal on device 120. For example, display 122 may light up with a visible alert notice, or device 120 may emit a sound or vibration, or all of the above may occur. The person carrying the PCC device 120 is accordingly alerted that at least one room 20 has initiated a lockdown due to a threat.

Figure 3B:
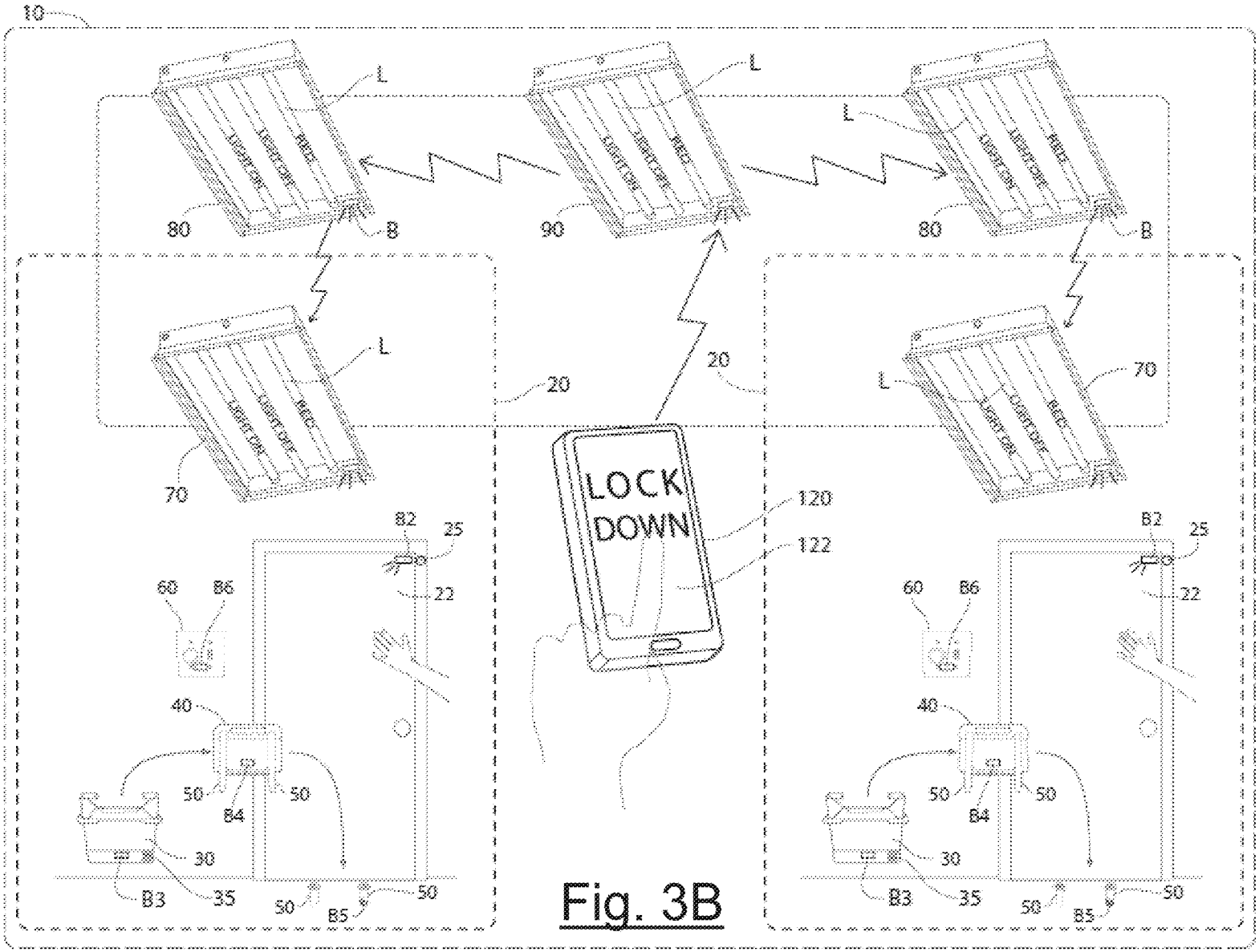
FIG. 3B schematically shows a system response to an administrator-initiated lockdown.

Referring next to FIG. 3B, there is schematically represented a lockdown via the PCC device 120; that is, a lockdown in which the PCC device 120 is used to manually send a signal to the smart lighting grid 100 through the nearest fixture 70, 80, or 90, which is then relayed through all of the fixtures in grid 100 to change their state to the lockdown-alert status (e.g., one or more light tubes in each BLE-equipped fixture goes red, one goes dark; a dedicated warning tube that was dark goes red; etc.). This provides an instant, building-wide visible alert to the teachers or other personnel in every room 20 to immediately pull boots 40 from boxes 30 and secure their doors 22 and/or to take whatever other lockdown action has been agreed on in advance. The PCC device 120 can activate the system, along with any other enabled secondary communication and/or control device 220 in the building 10, for instance using a common or shared security protocol (such as, by way of non-limiting example, a secure passcode, fingerprint or swipe (same as unlocking a smart phone)). As will be appreciated, such security measures serve to preclude unwanted or unauthorized personnel from being able to grab a device 120 or 220 and initiate a lockdown or otherwise control the system.

Figure 3C:
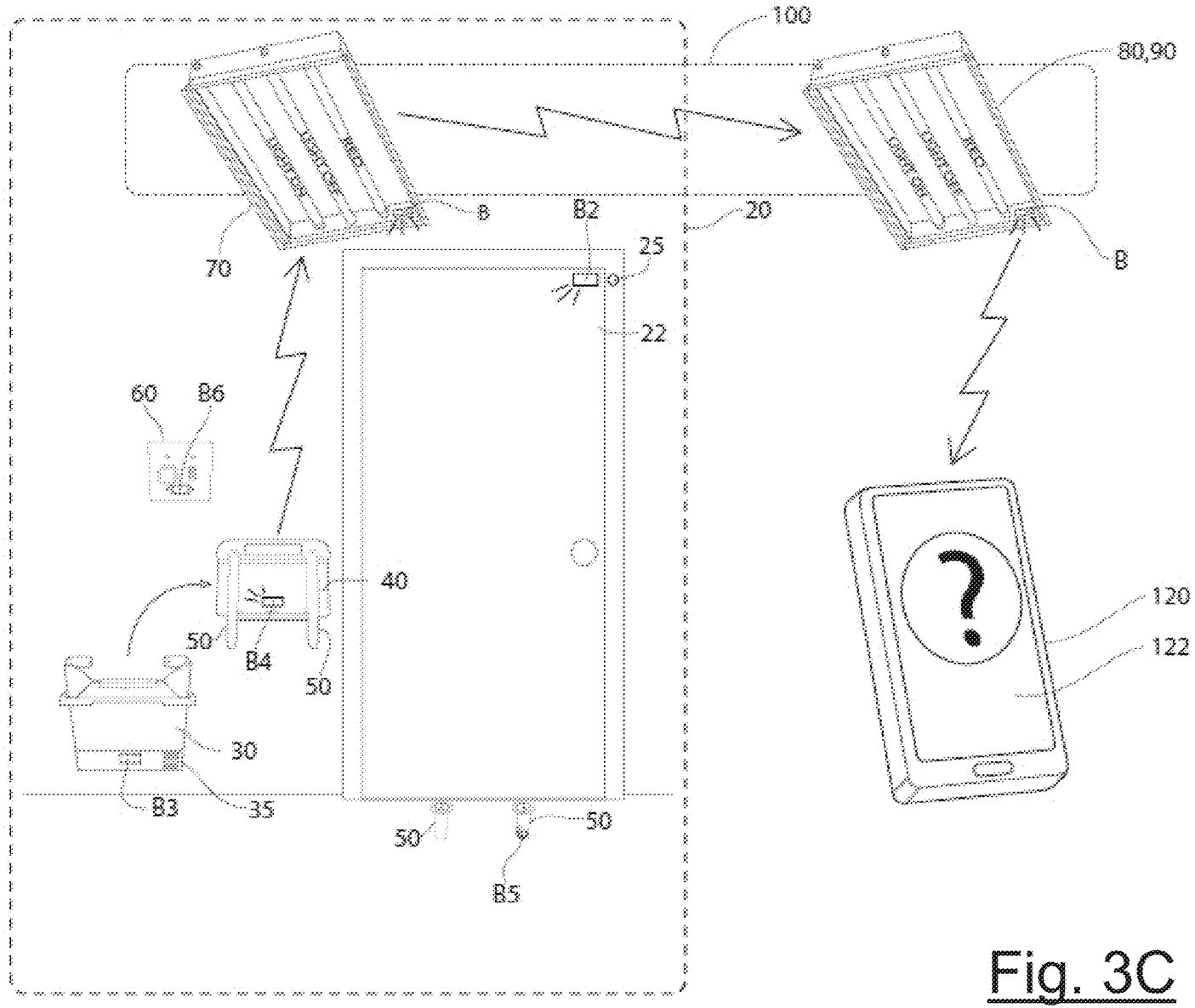
FIG. 3C schematically shows a system response to an accidental, delayed, or prank-initiated lockdown.

Turning next to FIG. 3C, there is schematically depicted the system response if boot 40 is accidentally pulled from box 30, or pulled as a prank, or otherwise not promptly inserted in floor sockets 50. A controller "substation" in box 30 may comprise a BLE module on a board with the switch B3 mounted to it. The substation may also house the audible circuitry and other smart programmable circuitry), and may also include a timer triggered by removal of boot 40 from the box. The timer is turned off by receipt of the wireless signal from BLE sensor B5 in floor socket 50 when the corresponding boot pin 42 is inserted into that socket. If the timer is not signaled to shut off within a predetermined time frame, e.g. two or three seconds, the box 30 indicates a boot-out alert as in FIG. 3A, but the BLE sensor B3 in box 30 substation 32 will relay a modified alert status to the PCC device 120 through grid 100, indicating that the boot 40 has not been placed in the sockets and that the room 20 is not locked down for some reason. The display 122 on device 120 will accordingly show a modified alert symbol or notice, as schematically shown in FIG. 3C.

Figure 5:
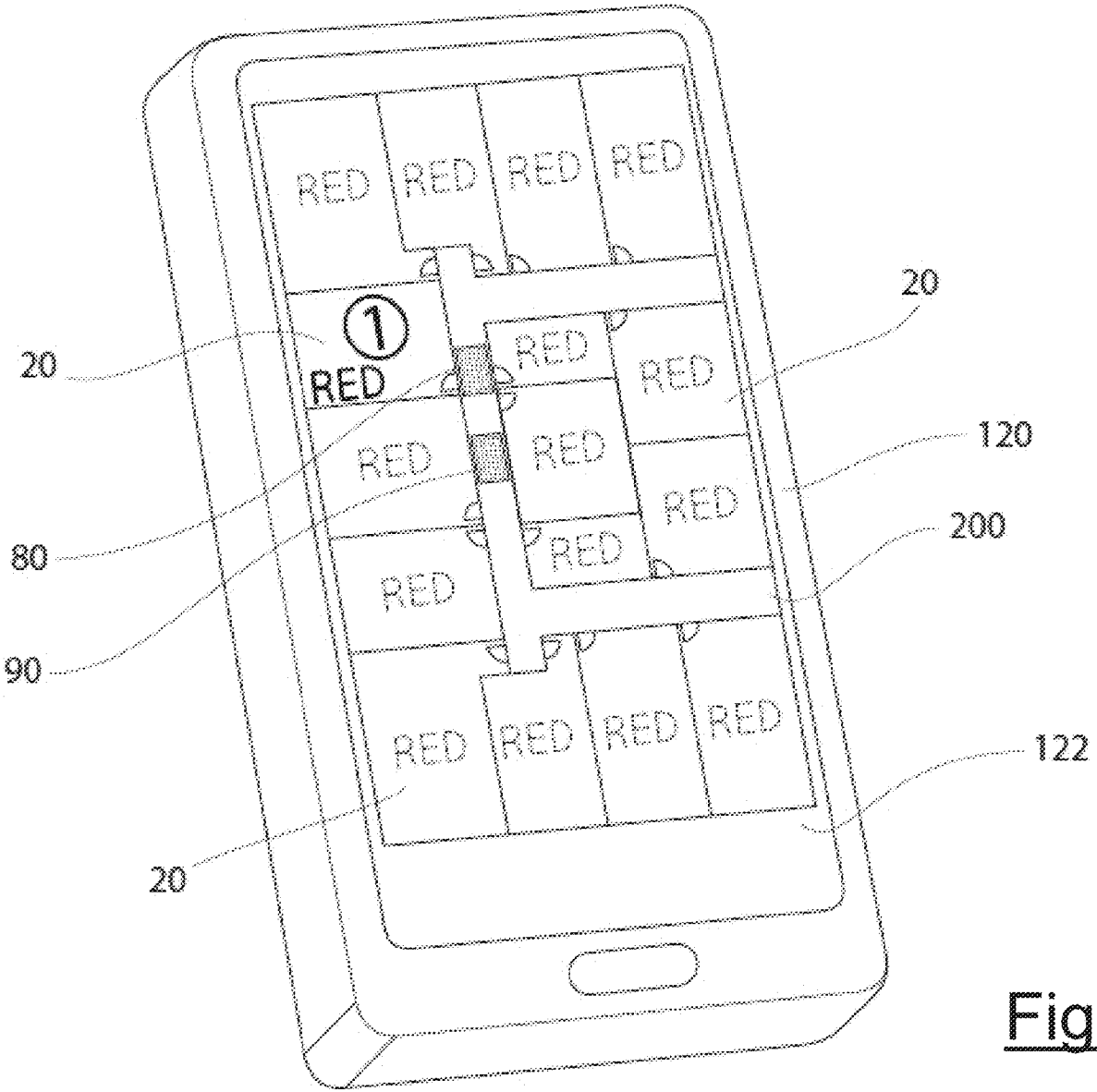
FIG. 5 schematically shows a lockdown status map on an administrator's smartphone, corresponding to initial boot-out and lockdown conditions in one room.
Figure 6:
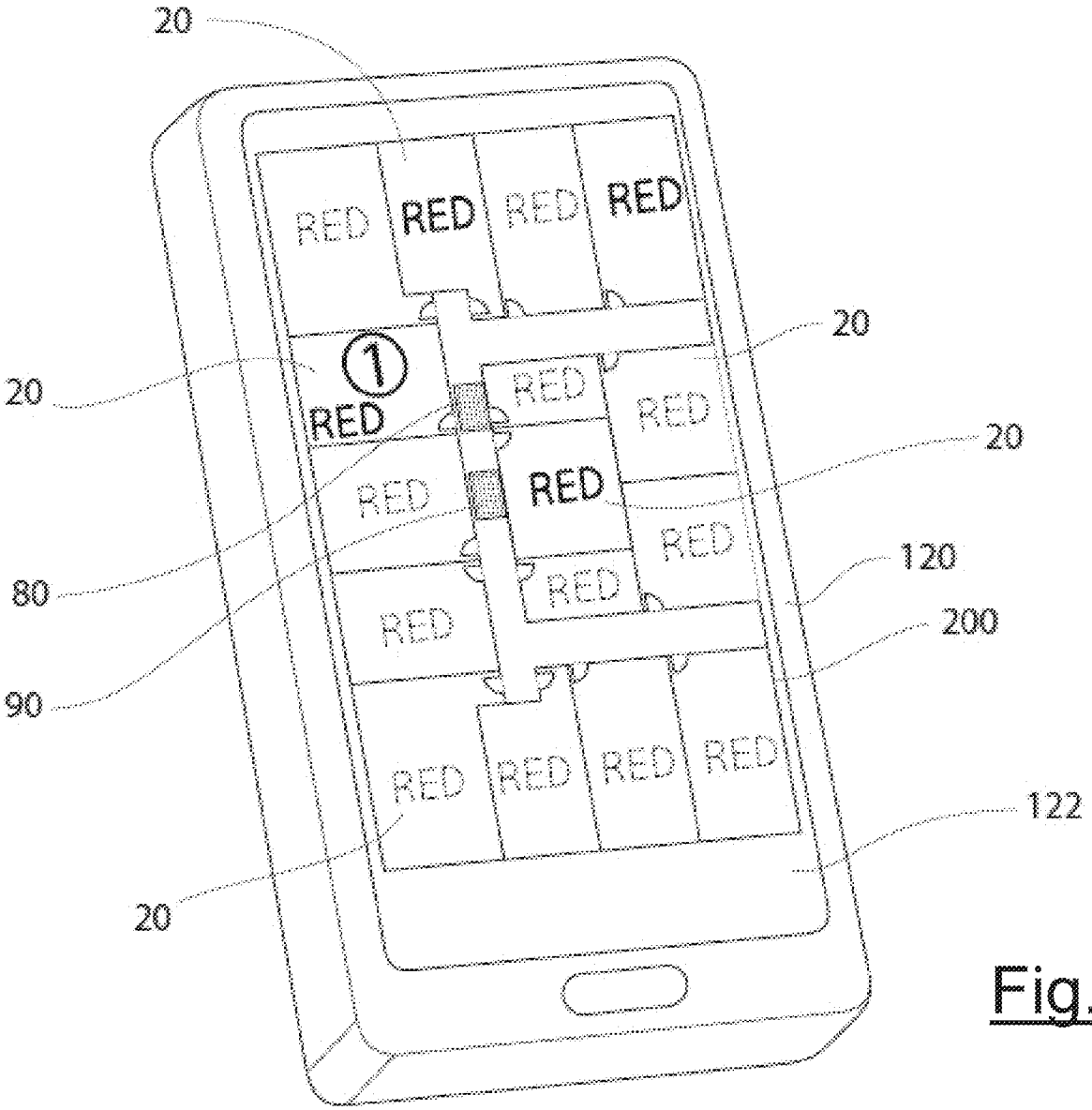
FIG. 6 is similar to FIG. 5, schematically showing the in-progress lockdown status of all rooms after the initial building-wide alert.
Figure 7:
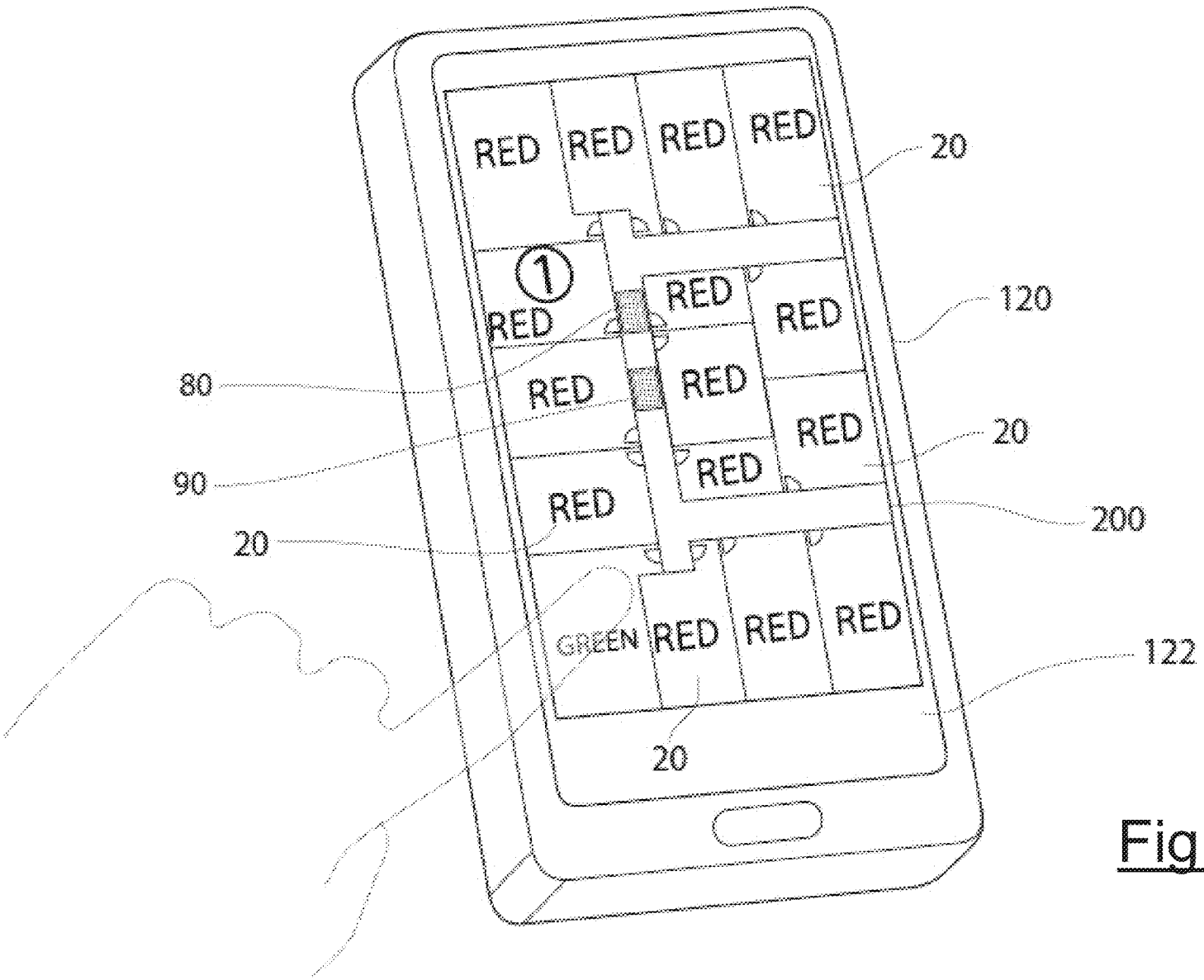
FIG. 7 is similar to FIG. 5, schematically showing the lockdown status map when all rooms have been locked down.

In the illustrated example, the at least one PCC device 120 is also provided with a virtual room map 200 of the school building, shown schematically in FIGS. 5-7. Map 200 may be retrieved and displayed from the device's memory manually via the touchscreen, or automatically by an app stored in the phone's memory and responsive to the alert and lockdown signals from the lighting grid 100. Upon receipt of the initial "boot out" alert or "prank" signal from a room-initiated lockdown or prank situation, the map can be displayed on screen 122 to show the lockdown status of the initiating room, for example by shading the initiating room in a dark or solid red (solid lines) as shown in FIG. 5 and optionally numerically identify and store in memory this initiating room with a mark such as "#1" for future use or reference.

After the initial boot-out alert, if the initiating room 20 is locked down within the predetermined time interval by inserting boot 40 in floor sockets 50, the status of all rooms 20 is displayed on screen 122, shaded or colored or otherwise visually marked according to lockdown status. For example, all other rooms 20 can be initially shaded a light or transparent red (shown as "RED" in shaded phantom in FIG. 5) until their respective boots 40 are inserted fully in floor sockets 50, at which point their color status would be changed to a solid or dark red.

FIG. 6 shows a partial building lockdown status, with some rooms in shaded red and some in solid red, as the room's transition from a boot-out or alerted status to a locked-down status.

FIG. 7 shows a completed building lockdown status on map 200, with all rooms in solid red.

Figure 8:
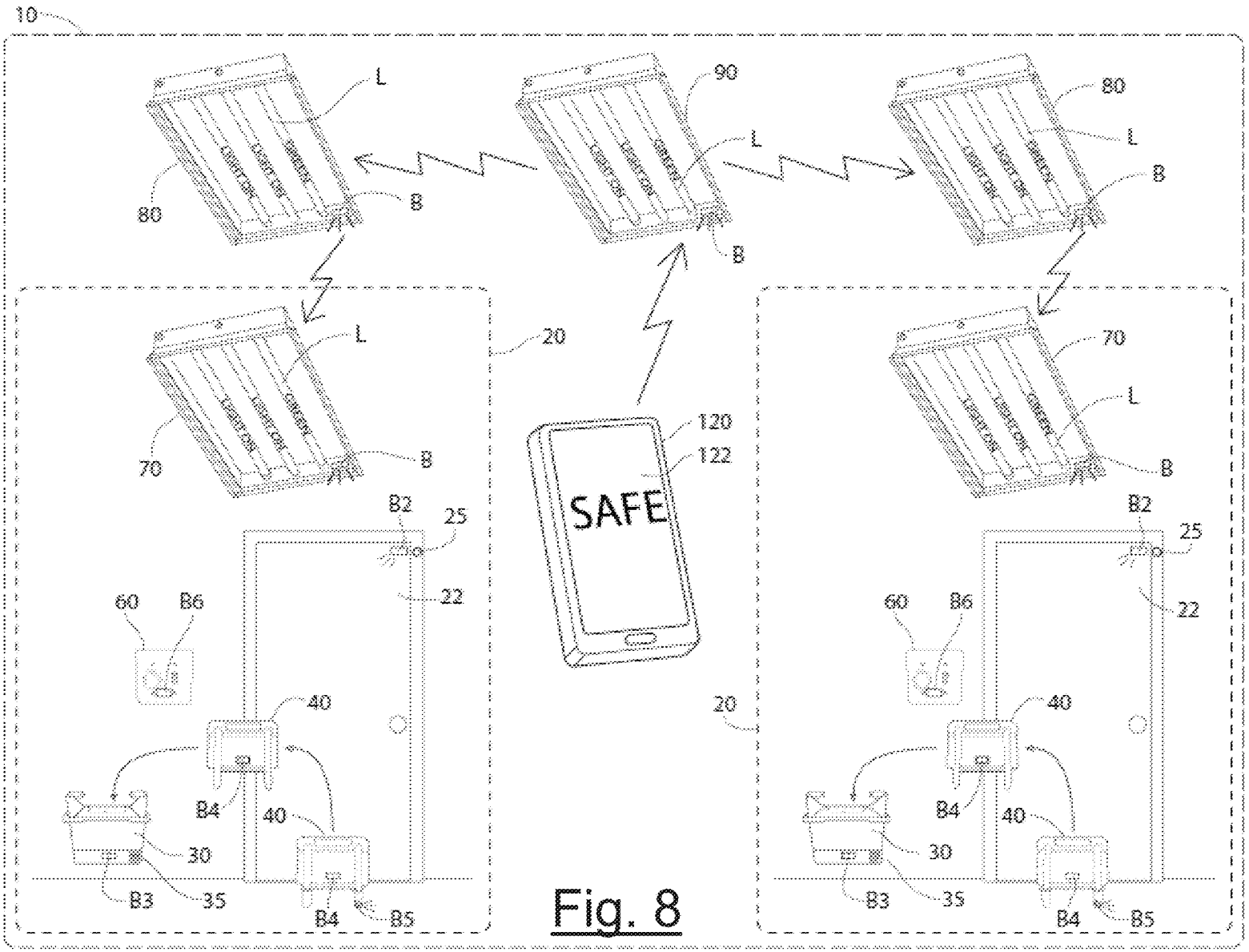
FIG. 8 schematically shows the building in a completed lockdown status, and a subsequent administrator-initiated "all clear" signal.

Referring now to FIG. 8, there is shown one of the light tubes in the lighting fixtures changed to a corresponding or complementary color, e.g. from red to green, letting those in the building 10 know that all rooms are properly locked down. In addition, the system can control the lighting from at least the PCC device 120 and perform a manual evacuation. The person(s) controlling the PCC device 120 can signal "all clear" from the device and all smart lights 70, 80, 90 turn green, signaling "all clear" so that rooms 20 can open their doors 22. Alternatively, the person controlling the PCC device 120 can choose manual evacuation mode, in which that person can touch the map locations or icons representing individual rooms 20 or individual light fixtures 70, 80, 90 identified on the room map 200 on the touchscreen of PCC device 120 to change to green or whatever color may be used to signal "evacuate" to people in the building, thereby releasing rooms from lockdown status and/or evacuating the building via the PCC device 120. The person controlling the PCC device 120 may even direct evacuation by altering the lighting in only certain hallways or certain parts of the building to establish preferred, clearly marked routes to the exit doors.

The ongoing progress of the lockdown as displayed on the PCC device 120 allows personnel inside and outside the building to coordinate an effective response. After all rooms 20 are locked down and the threat is cleared, the person controlling the PCC device 120 may then send an "all clear" or "safe" signal to all rooms in the building via device 120 through the lighting grid 100. As shown schematically in FIG. 8, this may result in light fixtures 70, 80, and 90 returning to a normal, non-colored, and/or more fully lit condition. In one embodiment of the invention, for example, one tube may remain green, and the previously darkened tube may be turned back on. Depending on the protocol in effect, teachers in rooms 20 may then remove boots 40 from the floor sockets 50 and open their doors, or they may shelter in place until security personnel equipped with a special tool remove boots 40 from sockets 50 from outside the rooms, as taught in the Couturier published application referenced above.

According to the system of the present invention in one embodiment thereof, the outside security personnel 320 in FIG. 1 further comprises an external communication and control device (comprehended generally by the "Authorities" box designated by reference numeral 320) disposed at a location remote from the building 10. The external communication and control device 320 is in communication with the PCC device 120, as discussed heretofore, so as to receive information therefrom respecting the status of the various lockdown components and the smart lighting grid. It is also, according to the illustrated embodiment, operative to take "pass-through" control of the PCC device, such that the external communication and control device is at least operative to receive information as to whether the room lockdown components are in the deployed (e.g., "boot out") condition thereof, and to independently effect a change in the color of at least some of the smart light fixtures in the smart lighting grid. Broadly speaking, the external communication and control device is operative to function as the PCC device 120 as heretofore described, such that outside authorities (e.g., police, security personnel, etc.) are able to remotely effect changes in the building as needed—e.g., to initiate a lockdown, to terminate a lockdown, to communicate with persons in the building, etc.

While it is contemplated in the illustrated embodiment that the external communication and control device 320 is in communication with the lockdown components and smart lighting grid via the PCC device 120, it is also contemplated that such communication may be effected by other conventional means. For instance, and without limitation, it is contemplated that the smart lighting grid and lockdown components may communicate to a networked (whether locally or via the Internet through a local server) computer which, in turn, is also in communication with each of the PCC device 120 and the external communication and control device 320.

External control of the building lockdown system via the external communication and control device 320 comprises, according to the exemplary embodiment, three communication modes: (a) visual control, wherein the outside authorities adjust visual signals such as lockdown status notifications and escape routes by selectively altering the lighting state of BLE light fixtures throughout the building, and/or by altering visual representations of the building lockdown status on PCC devices in the building; (b) two-way text messaging control through the BLE smart lighting grid, in which multiple authorized PCC devices in the hands of administrators or staff are provided with blanketed general messaging and/or individual, point-to-point messaging for the purposes of notification and/or intelligence gathering; and (c) text audio control, wherein BLE-equipped light fixtures and room lockdown components are also equipped with audio speakers for relaying text audio messages from the outside authorities through the BLE mesh network in the building.

As will be appreciated, the external communication and control device 320 may, like the other devices 120 and 220 described herein, be a phone, computer, tablet computer, etc.

Figure 10:
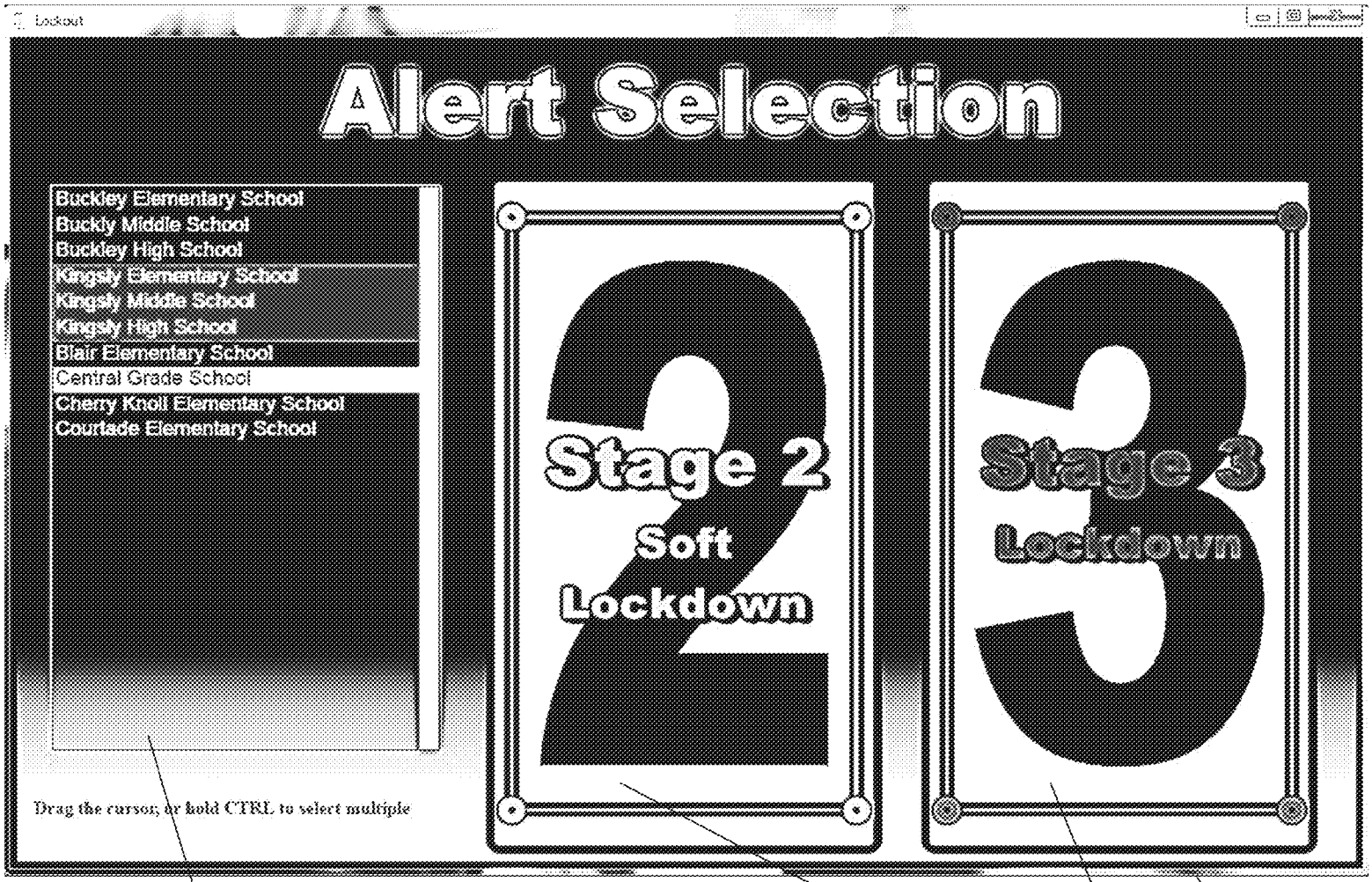
FIG. 10 is a sample display screen on an external control device utilized in one embodiment of the system of the present invention.
Figure 11:
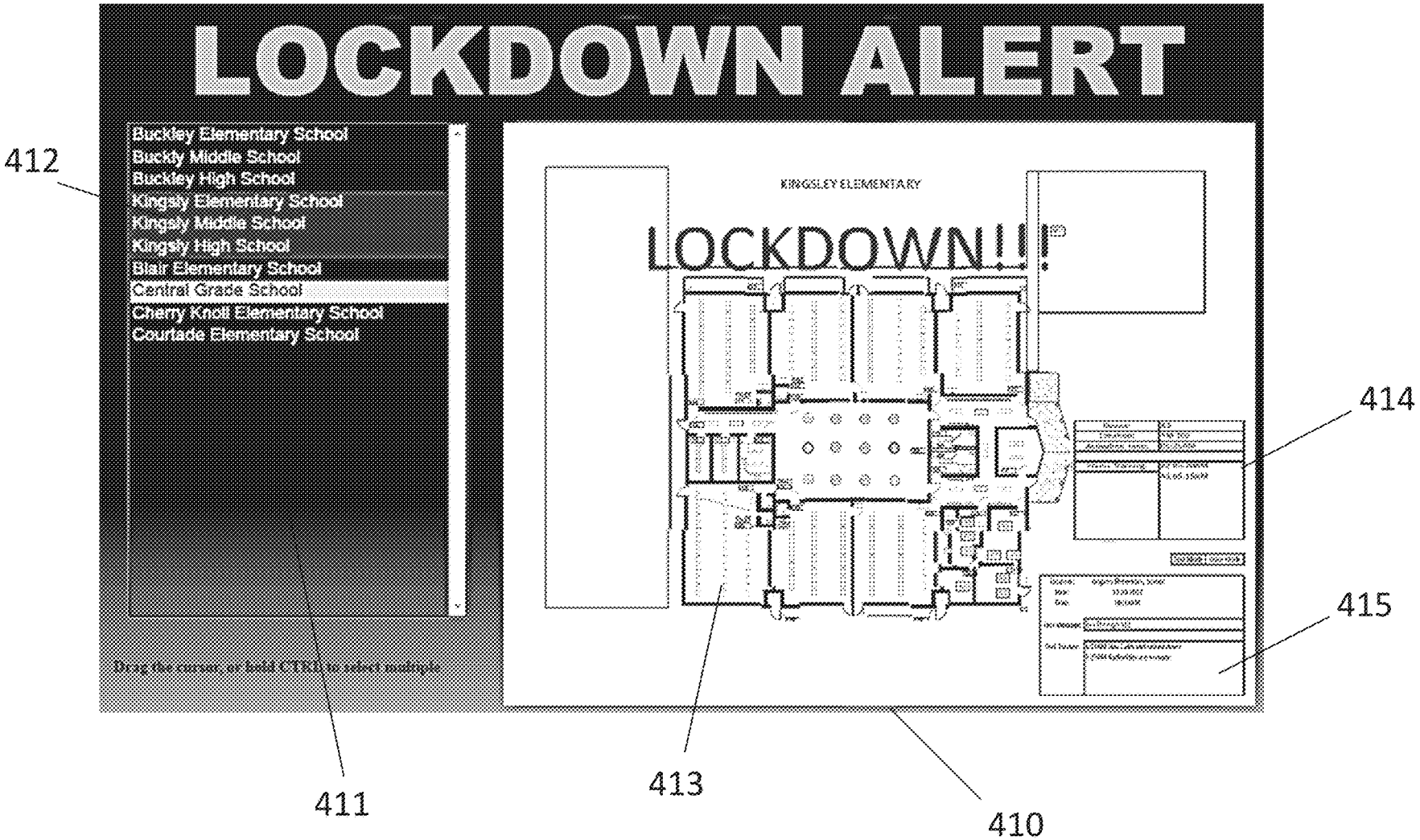
FIG. 11 shows a further display screen on the external control device of FIG. 10.
Figure 12:
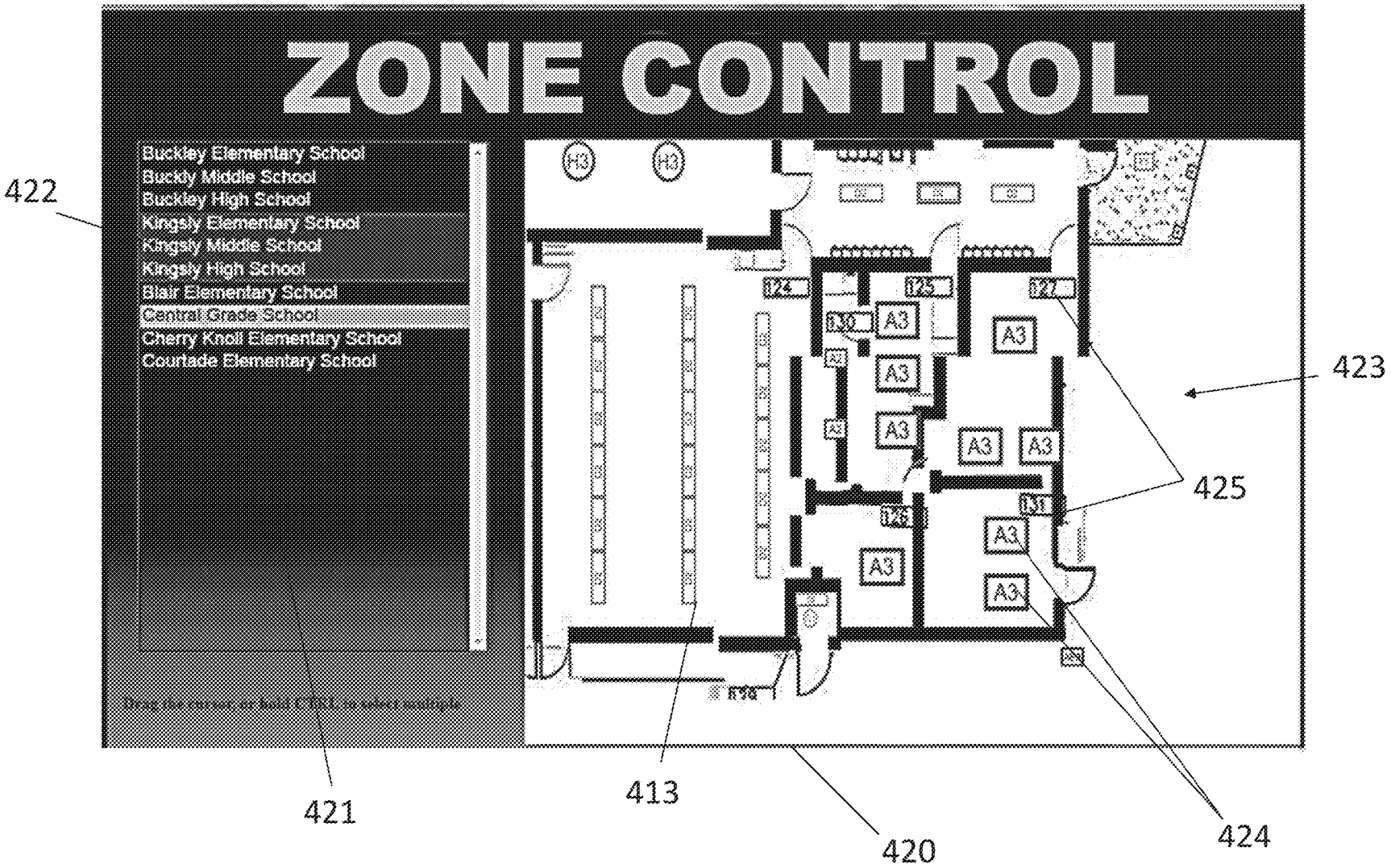
FIG. 12 shows a still further display screen on the external control device of FIG. 10.

Turning next to FIGS. 10, 11, & 12 there are shown exemplary display screens on the external communication and control device 320 by which the three aforementioned communication modes may be effected. The display screens of FIGS. 10, 11 & 12 represent a useful format for outside personnel to monitor buildings 10 under their jurisdiction for lockdown notifications from the PCC devices (e.g., 120) in the buildings (e.g., 10), as well as to initiate lockdowns in such buildings remotely.

More specifically, FIG. 10 depicts the exemplary form of an "Alert Selection" display screen 400 of the external communication and control device via which authorities can initiate a lockdown remotely. More particularly, display screen 400 includes a left-hand portion comprising a listing 401 of buildings (e.g., schools, as per the illustrated embodiment) under the jurisdiction of the authorities. One or more of these buildings may be selected, such as via a cursor, for initiation of a remote lockdown. Upon selection of one or more buildings from the listing 401, the authorities may initiate the lockdown by selecting one of the lockdown "buttons" 402 or 403.

As shown in FIG. 10, two types of lockdowns may be initiated: A "soft lockdown," represented by "button" 402; and a "lockdown," represented by "button" 403. In a "soft lockdown," one or more distinctive audible or visual indicators of the type described above may be activated in the affected building to advise of the need to take appropriate measures (as agreed upon in advance) short of engaging boots 40 to barricade or secure doors 22. Such indicators may include audible signals from loudspeakers, from the speaker 35 in each box 30, etc. Indicators may also include the activation of one or more light tubes in the BLE-equipped fixtures 70, 80, 90, etc. Still further indicators may be conveyed to the secondary communication and/or control devices 220 via the authorities, including, optionally, using the PCC device 120 as a communication hub.

In a "lockdown," by contrast, one or more distinctive audible or visual indicators of the type described above may be activated in the affected building to advise of the need to take appropriate measures (as agreed upon in advance), including engaging boots 40 to barricade doors 22. As above, such indicators may include audible signals from loudspeakers, from the speaker 35 in each box 30, etc. Indicators may also include the activation of one or more light tubes in the BLE-equipped fixtures 70, 80, 90, etc. Still further indicators may be conveyed to wireless communication devices 220 via the authorities, including, optionally, using the PCC device 120 as a communication hub.

Turning next to FIG. 11, there is shown the exemplary form of a "Lockdown Alert" display screen 410 available to outside security personnel via the external communication and control device 320 when a lockdown is initiated in the building (e.g., 10). The same school listing described in connection with FIG. 10 is on the left-hand portion (designated at 411), showing which schools are in lockdown (those highlighted in red 412), while the right-hand portion depicts a floor plan 413 of the building showing the location and current status of all smart light fixtures 70, 80, 90, etc. and room lockdown components 30, 40, etc. in the building, thereby providing a visual indication of which boots 40 have been removed from their boxes 30, providing a visual indication of which light fixtures 70, 80, 90, etc. have undergone a color change. The particular floor plan 413 displayed may be varied by the outside security personnel by selecting one of the schools from the listing 411. For the sake of consistency with the PCC and secondary displays 120 and 220, the boots 40 which are not deployed are colored green in the display, while those which have been deployed and are in lockdown status are colored red. For the smart light fixtures 70, 80, 90, etc., the right-hand portion of display 410 shows if a light fixture has been activated or not; i.e., whether the color of the light fixture has been changed in any manner from normal light, as described above.

Also in the right-hand portion of the display 410 is provided a lockdown-device status-tracker display 414 which functions to provide a textual, time-stamped entry showing the current status, and subsequent status changes in, all smart light fixtures 70, 80, 90, etc. and room lockdown components 30, 40, etc. in the building.

Also in the right-hand portion of the display 410 is provided a text-and-voice notification display 415. Authorities or other personnel in control of the external communications and control device 320 can send text messages to all or selected ones of the PCC and/or secondary communication and/or control devices 120, 220. This is accomplished from the interface of the external communication and control device 320, which is programmed to be in selective communication via text and/or voice with all such devices 120, 220 in the affected building. Using conventional technology, the BLE mesh network of the smart lighting grid 100 cannot transfer audio from the external communication and control device 320 to any of the PCC or secondary devices 120, 220. Only direct text communication or text-to-voice communication is possible. Accordingly, the devices 120, 220 may be programmed to be able to convert to voice any text messages from the external communication and control device 320.

Turning next to FIG. 12, there is shown the exemplary form of a "Zone Control" display screen 420 available to outside security personnel via the external communication and control device 320 when a lockdown is initiated in the building (e.g., 10). The same school listing described in connection with FIGS. 10 and 11 is on the left-hand portion (designated at 421), showing which schools are in lockdown (those highlighted in red 422), while the right-hand portion depicts a floor plan 423 of the building showing the location and current status of all smart light fixtures (for example as shown at 424) and room lockdown components (for example as shown at 425) in the building, thereby providing a visual indication of which boots 40 have been removed from their boxes 30, as well as providing a visual indication of which light fixtures 70, 80, 90, etc. have undergone a color change.

Outside security personnel can interact with the floor plan 423 by touching (when the display is via a touch-screen type device, such as a smartphone, tablet computer, etc.) or designating via a mouse individual lockdown components (e.g., 425) and/or smart light fixtures (e.g., 424) in order to change their status from green to red and/or lockdown to "all clear."

While initiation of lockdown via external authorities may be prompted via any known means, including the presence on-site of one or more authorities who report an incident mandating lockdown initiation, it is contemplated in one embodiment of the present invention that the "smart room light fixtures" may be equipped with microphones programmed to detect the occurrence of one or more gunshots and to relay such occurrence, through the smart lighting grid, to the PCC device 120 and the external communication and control device 320. By way of example, any of the display screens heretofore described in FIGS. 10 and 11 may be programmed to provide a visual and/or audible indication that one or more gunshots have been detected and, moreover, to indicate (such as in the floor plan 413) the specific smart light fixture or fixtures which detected the gunfire.

Figure 13:
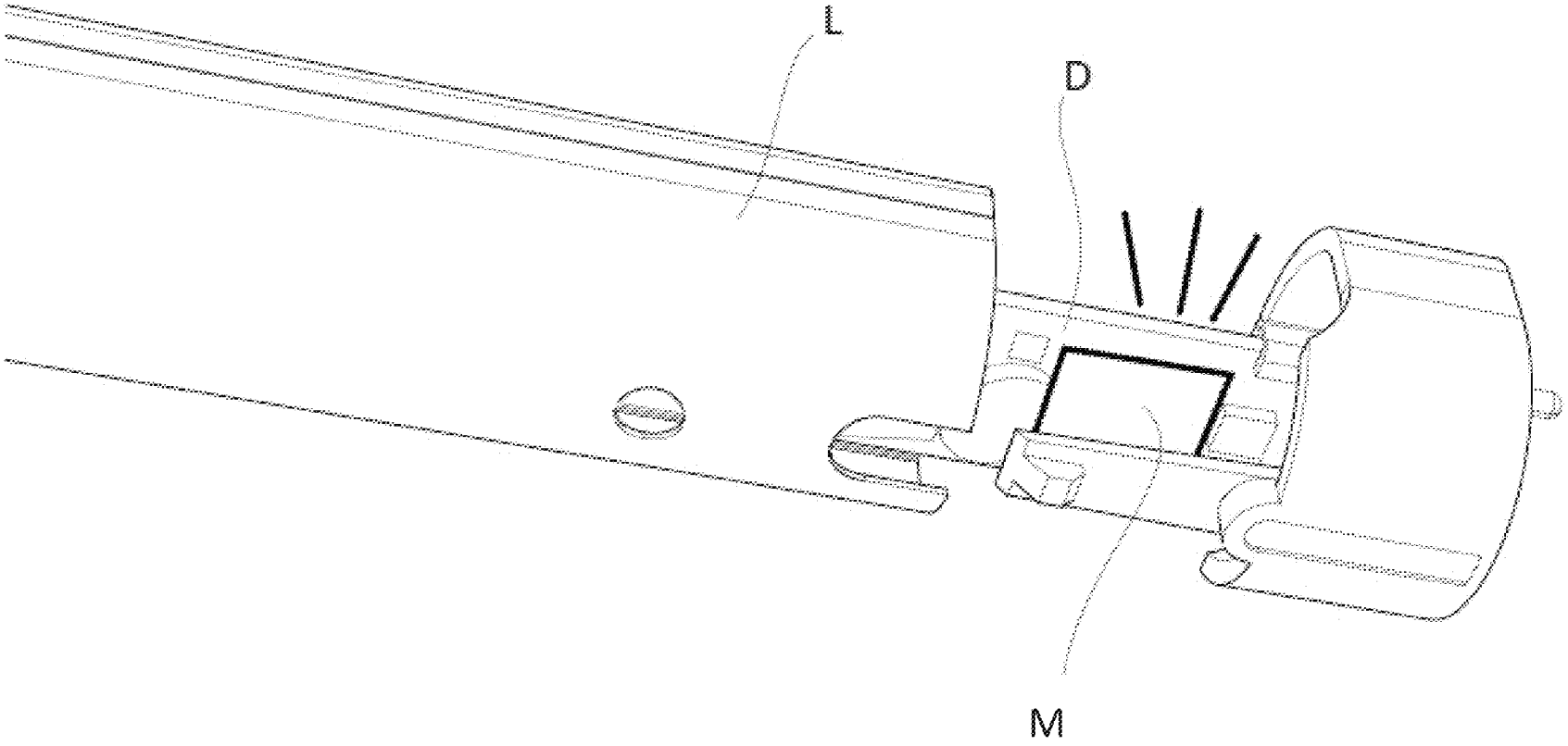
FIG. 13 shows one option for mounting a BLE audio sensor in a light fixture in the BLE smart lighting grid of FIG. 1.

One such shot-detection technology that may be incorporated into the smart light fixtures of the present invention is commercially available through SHOTSPOTTER (Newark, Calif.). In FIG. 13 there is shown an exemplary method for mounting a microphone M in one of light fixtures 70, 80, or 90 in the grid.

Optionally, the external communication and control device 320 of the present invention has a "drill" mode. This has all the same functionality as the lockdown mode described above, except all involved persons (both outside authorities and people in the affected building) are aware it is a drill rather than real lockdown. According to the illustrated embodiment, selection of "drill" mode is made at the PCC device 120 by building personnel.

According to one form of the invention where the external communication and control device 320 is operative to control the smart lighting grid 100 in the manner heretofore described, it is contemplated that each at least one PCC device 120 in the building 10 is unable to effect an "all clear" signal except (1) when the system is in "test" mode (i.e., when there is not a real threat in the building) or (2) when authorized by the outside security personnel (such as, for instance via a password or other code provided by the outside security personnel to the person in possession of the PCC device 120). Alternatively, or in addition, the external communication and control device 320 is operative to effect an "all clear" signal. As will be appreciated, the rationale behind optional feature of the inventive system is to avoid the scenario where an intruder or other unauthorized person takes control of a PCC device 120 to effect an improper "all clear" signal.

While the components of the lockdown system are shown above in association with individual room doors, the above examples and the term "room" should be construed to include groups of rooms in the building closed by a common door or set of doors, for example in a wing or hallway accessed and secured by a single door or set of doors.

It is to be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention.

It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention supported by the above disclosure should accordingly be construed within the scope of what it teaches and suggests to those skilled in the art, and within the scope of any claims that the above disclosure supports.

The claims are representative of the invention and are not intended to limit the claimed invention with respect to other features which are supported by or might become apparent from the description, and which might be claimed subsequently.

The invention in which an exclusive property or privilege is claimed is defined as follows:

1. A lockdown system for use in a building including multiple rooms with doors providing access to the rooms, the lockdown system comprising:

at least one room lockdown component provided in each of a plurality of the rooms, the room lockdown components comprising door-securing devices that are external of the doors and, in a deployed condition of the room lockdown components, are manually positioned inside said rooms to prevent opening of the doors, the room lockdown components further characterized by a non-deployed condition in which the door-securing devices are positioned at storage locations inside the rooms, and wherein further each room lockdown component is operative to automatically signal initiation of a lockdown event when its door-securing device has been moved from its storage location; and at least one communication device operative to receive the signaled initiation of a lockdown event when any one or more of the door-securing devices have been moved from their storage locations, and to provide an alert notification of the initiation of the lockdown event.

2. The lockdown system of claim 1, wherein each of the room lockdown components is operative to automatically signal initiation of a lockdown event by communicating, via a wireless communication network, one or more state-indicating signals indicating when the door-securing device has been moved from its storage location.

3. The lockdown system of claim 2, further comprising smart light fixtures positioned inside the building, the smart light fixtures forming part of the wireless communication network.

4. The lockdown system of claim 3, wherein the smart light fixtures are positioned inside and/or outside at least the plurality of the rooms.

5. The lockdown system of claim 3, wherein the wireless communication network is a mesh network.

6. The lockdown system of claim 5, wherein the wireless communication network is a BLE mesh network.

7. The lockdown system of claim 3, wherein at least a plurality of the smart light fixtures are operative to:

selectively provide illumination in one or more of a plurality of colors;

receive the state-indicating signals from the room lockdown components via the wireless communication network; and in response to receipt of the state-indicating signals indicating that any one or more of the door-securing devices have been moved from the storage locations therefor, automatically provide illumination in one of the plurality of colors that has been predesignated to notify persons in the building to manually remove the door-securing devices from their storage locations and manually position them in the deployed condition ("the notification color").

8. The lockdown system of claim 7, wherein the at least one communication device is operative to initiate a lockdown of all or part of the building by effecting, via the wireless communication network, illumination of one or more of the plurality of smart light fixtures in the notification color.

9. The lockdown system of claim 8, wherein the at least one communication device is a primary communication and control (PCC) device disposed in the building.

10. The lockdown system of claim 9, further comprising at least one secondary communication and/or control device disposed in the building, the at least one secondary communication and/or control device in communication with the at least one PCC device and operative to receive notifications therefrom.

11. The lockdown system of claim 9, wherein the at least one communication device further comprises an external communication and control device provided at a location remote from the building, the external communication and control device in communication with, and operative to control, at least the plurality of the smart light fixtures configured to be selectively illuminated, wherein further the external communication and control device is operative to initiate a lockdown of all or part of the building by effecting, via the wireless communication network, illumination of one or more of the plurality of smart light fixtures in the notification color.

12. The lockdown system of claim 11, wherein the external communication and control device is in communication with at least the plurality of the smart light fixtures via the at least one PCC device.

13. The lockdown system of claim 11, wherein the external communication and control device is in communication with at least the plurality of the smart light fixtures solely via the at least one PCC device.

14. The lockdown system of claim 9, wherein the PCC device is operative to provide a visual display showing at least whether any one or more of the door-securing devices have been moved from their storage locations.

15. The lockdown system of claim 7, wherein the at least one communication device is operative to provide a visual display depicting a map of the building showing the locations of at least the plurality of smart light fixtures configured to be selectively illuminated, the locations of the room lockdown components, and whether each of the room lockdown components is in the non-deployed condition.

16. The lockdown system of claim 15, wherein the illumination color of each of the said smart light fixtures may be independently selectively changed via the at least one communication device.

17. The lockdown system of claim 3, wherein further one or more of the smart light fixtures are operative to receive text messages and to convert those text messages into audio which emanates from one or more speakers provided in said one or more smart light fixtures, and wherein the at least one communication device is operative to convey text messages to said one or more smart light fixtures.

18. The lockdown system of claim 2, wherein the room lockdown components each comprise a storage device for storing the door-securing devices in the storage locations, and wherein further each storage device is operative to automatically communicate, via the wireless communication network, the one or more state-indicating signals when the door-securing device has been moved from its storage location.

19. The lockdown system of claim 18, wherein further each door-securing device is operative to automatically communicate, via the wireless communication network, the one or more state-indicating signals when the door-securing device has been moved from its storage location.

20. The lockdown system of claim 2, wherein each door-securing device has at least a first pin for insertion into a mating socket provided proximate a door to be secured, wherein further the room lockdown components are in the deployed condition when the at least first pin is received in the socket, and wherein further each room lockdown component is operative to automatically communicate to the at least one communication device, via the wireless communication network, when its door-securing device is in the deployed condition.

21. The lockdown system of claim 20, wherein the at least one communication device is operative to provide a visual display showing at least whether any one or more of the door-securing devices have been moved from their storage locations and whether any one or more of the door-securing devices have been moved to the deployed condition.

22. The lockdown system of claim 20, wherein the at least one communication device is operative to provide a visual display showing each door-securing device that has been moved from its storage location but has not been moved to the deployed condition within a predetermined period of time.

23. The lockdown system of claim 20, wherein the mating socket is operative to automatically communicate to the at least one communication device, via the wireless communication network, that the door-securing device is in the deployed condition of the room lockdown components when the at least first pin is received in the socket.

24. The lockdown system of claim 1, wherein the at least one communication device is operative to automatically notify one or more persons located outside of the building when a lockdown event has been initiated.

25. A lockdown system for use in a building including multiple rooms with doors providing access to the rooms, the lockdown system comprising:

at least one room lockdown component provided in each of a plurality of the rooms, the room lockdown components comprising door-securing devices that are external of the doors and, in a deployed condition of the room lockdown components, are manually positioned inside said rooms to prevent opening of the doors, the room lockdown components further characterized by a non-deployed condition in which the door-securing devices are positioned at storage locations inside the rooms;

smart light fixtures positioned inside the building, the smart light fixtures operative to selectively provide illumination in one or more of a plurality of colors, including a color that has been predesignated to notify persons in the building to manually remove the door-securing devices from their storage locations and manually position them in the deployed condition ("the notification color"); and at least one communication device operative to initiate a lockdown of all or part of the building by remotely effecting illumination of one or more of the plurality of smart light fixtures in the notification color;

wherein each room lockdown component is operative to automatically signal initiation of a lockdown event when its door-securing device has been moved from its storage location; and wherein further the at least one communication device is operative to receive the signaled initiation of a lockdown event when any one or more of the door-securing devices have been moved from their storage locations, and to provide an alert notification of the initiation of the lockdown event.

26. The lockdown system of claim 25, wherein each of the room lockdown components is operative to automatically signal initiation of a lockdown event by communicating, via a wireless communication network, one or more state-indicating signals indicating when the door-securing device has been moved from its storage location.

27. The lockdown system of claim 26, wherein the smart light fixtures form part of the wireless communication network.

28. The lockdown system of claim 27, wherein the wireless communication network is a mesh network.

29. The lockdown system of claim 26, wherein at least a plurality of the smart light fixtures are operative:

to receive the state-indicating signals from the room lockdown components via the wireless communication network; and in response to receipt of the state-indicating signals indicating that any one or more of the door-securing devices have been moved from the storage locations therefor, automatically provide illumination in the notification color.

30. The lockdown system of claim 26, wherein the room lockdown components each comprise a storage device for storing the door-securing devices in the storage locations, and wherein further each storage device is operative to automatically communicate, via the wireless communication network, the one or more state-indicating signals when the door-securing device has been moved from its storage location.

31. The lockdown system of claim 30, wherein each door-securing device has at least a first pin for insertion into a mating socket provided proximate a door to be secured, wherein further the room lockdown components are in the deployed condition when the at least first pin is received in the socket, and wherein further each room lockdown component is operative to automatically communicate to the at least one communication device, via the wireless communication network, when its door-securing device is in the deployed condition.

32. The lockdown system of claim 31, wherein the mating socket is operative to automatically communicate to the at least one communication device, via the wireless communication network, that the door-securing device is in the deployed condition of the room lockdown components when the at least first pin is received in the socket.

33. The lockdown system of claim 31, wherein the at least one communication device is operative to provide a visual display showing at least whether any one or more of the door-securing devices have been moved from their storage locations and whether any one or more of the door-securing devices have been moved to the deployed condition.

34. The lockdown system of claim 33, wherein the at least one communication device is operative to provide a visual display showing each door-securing device that has been moved from its storage location but has not been moved to the deployed condition within a predetermined period of time.

35. The lockdown system of claim 30, wherein the at least one communication device is operative to provide a visual display showing at least whether any one or more of the door-securing devices have been moved from their storage locations.

36. The lockdown system of claim 25, wherein the at least one communication device is operative to provide a visual display depicting a map of the building showing the locations of at least the plurality of smart light fixtures configured to be selectively illuminated, the locations of the room lockdown components, and whether each of the room lockdown components is in the non-deployed condition.

37. The lockdown system of claim 25, wherein the at least one communication device is a primary communication and control (PCC) device disposed in the building.

38. The lockdown system of claim 37, further comprising at least one secondary communication and/or control device disposed in the building, the at least one secondary communication and/or control device in communication with the at least one PCC device and operative to receive notifications therefrom.

39. The lockdown system of claim 37, wherein the at least one communication device further comprises an external communication and control device provided at a location remote from the building, the external communication and control device in communication with, and operative to control, at least the plurality of the smart light fixtures configured to be selectively illuminated, wherein further the external communication and control device is operative to initiate a lockdown of all or part of the building by remotely effecting illumination of one or more of the plurality of smart light fixtures in the notification color.

40. The lockdown system of claim 39, wherein the external communication and control device is in communication with at least the plurality of the smart light fixtures via the at least one PCC device.

41. The lockdown system of claim 39, wherein the external communication and control device is in communication with at least the plurality of the smart light fixtures solely via the at least one PCC device.

42. The lockdown system of claim 25, wherein the smart light fixtures are positioned inside and/or outside at least the plurality of the rooms.

43. The lockdown system of claim 25, wherein the illumination color of each of the said smart light fixtures may be independently selectively changed via the at least one communication device.

44. The lockdown system of claim 25, wherein further one or more of the smart light fixtures are operative to receive text messages and to convert those text messages into audio which emanates from one or more speakers provided in said one or more smart light fixtures, and wherein the at least one communication device is operative to convey text messages to said one or more smart light fixtures.

45. The lockdown system of claim 25, wherein the at least one communication device is operative to automatically notify one or more persons located outside of the building when a lockdown event has been initiated.

* * * * *